US010538992B2

(12) United States Patent
Woodford

(10) Patent No.: US 10,538,992 B2
(45) Date of Patent: Jan. 21, 2020

(54) FLOW SYSTEM

(71) Applicant: TCO AS, Indre Arna (NO)

(72) Inventor: Keith Woodford, Aberdeen (GB)

(73) Assignee: TCO AS, Indre Arna (NO)

( * ) Notice: Subject to any disclaimer, the term of this patent is extended or adjusted under 35 U.S.C. 154(b) by 426 days.

(21) Appl. No.: 14/777,796

(22) PCT Filed: Mar. 17, 2014

(86) PCT No.: PCT/EP2014/055319
§ 371 (c)(1),
(2) Date: Sep. 17, 2015

(87) PCT Pub. No.: WO2014/147032
PCT Pub. Date: Sep. 25, 2014

(65) Prior Publication Data

US 2016/0298419 A1 Oct. 13, 2016

(30) Foreign Application Priority Data

Mar. 17, 2013 (GB) ..... 1304859

(51) Int. Cl.
*E21B 34/10* (2006.01)
*E21B 34/08* (2006.01)
(Continued)

(52) U.S. Cl.
CPC ..... *E21B 34/10* (2013.01); *E21B 34/08* (2013.01); *E21B 34/101* (2013.01); *E21B 37/06* (2013.01);
(Continued)

(58) Field of Classification Search
CPC ..... E21B 34/10; E21B 34/101; E21B 34/06; E21B 34/08; E21B 43/16; E21B 37/06;
(Continued)

(56) References Cited

U.S. PATENT DOCUMENTS 4,911,199 A * 3/1990 Bontenbal ..... E21B 34/08 137/460
2013/0153044 A1 6/2013 Woodford

FOREIGN PATENT DOCUMENTS

GB 2217753 A 11/1989
WO WO-2011157985 A1 12/2011

OTHER PUBLICATIONS

International Search Report PCT/ISA/210 for International Application No. PCT/EP2014/055319 dated Feb. 4, 2015.
(Continued)

*Primary Examiner* — Nicole Coy
(74) *Attorney, Agent, or Firm* — Harness, Dickey & Pierce, P.L.C.

(57) ABSTRACT

A flow system comprises a system flow path extending from a system inlet to a system outlet. A pressure module is provided within the system flow path to establish a differential pressure between upstream and downstream sides thereof during flow from the system inlet to the system outlet The system also comprises a valve provided within the system flow path, and a valve actuator in pressure communication with the system flow path on upstream and downstream sides of the pressure module. The valve actuator is driven by a differential pressure established by the pressure module to move between a first position in which the valve is closed, and a second position in which the valve is opened.

50 Claims, 10 Drawing Sheets

(51) Int. Cl.

| | |
|---|---|
| ***E21B 37/06*** | (2006.01) |
| ***E21B 43/12*** | (2006.01) |
| ***E21B 43/20*** | (2006.01) |
| ***E21B 34/00*** | (2006.01) |

(52) U.S. Cl.
CPC ..... *E21B 43/121* (2013.01); *E21B 43/20* (2013.01); *E21B 2034/002* (2013.01); *E21B 2034/005* (2013.01)

(58) Field of Classification Search
CPC .. E21B 43/121; E21B 43/20; E21B 2034/002; E21B 2034/005; F16K 31/1221
See application file for complete search history.

(56) References Cited

OTHER PUBLICATIONS

Written Opinion of the International Searching Authority PCT/ISA/237 for International Application No. PCT/EP2014/055319 dated Feb. 4, 2015.

* cited by examiner

FLOW SYSTEM

FIELD OF THE INVENTION

The present invention relates to a flow system, and in particular, but not exclusively, to a flow system for use in downhole injection.

BACKGROUND TO THE INVENTION

Many different species of valve are known, and are used widely in many industries. Many valve designs are operated by some form of user controlled actuator, such as a valve handle, motor, ram or the like. Valves are also known which may be operated in accordance with properties of a fluid under control, such as fluid flow rates and pressures.

Valves are in widespread use in the oil and gas industry. For example, valves are commonly used in downhole injection systems. Examples of such downhole injection systems are provided in WO 2011/157985 and WO 2012/136966, the disclosure of which is incorporated herein by reference.

Oil or gas wells may require fluid to be injected for a variety of requirements. These may include but are not limited to:

Chemical Injection—this may involve the injection of speciality chemicals which are formulated to address issues such as scaling, wax build up, salt built up and the like. Chemical injection applications tend to be performed at very low flow rates which are a very small fraction of the flow rates of the actual produced reservoir well fluids.

Water De-Salting Injection—this may involve the injection of water of either a pure or derived composition to assist in the flushing away of salt deposits in an oil/gas producing region in oil or gas formations. These applications are generally performed at moderate rates of flow which are a small fraction of the flow rates of the actual produced reservoir well fluids.

Diluent Injection—this may involve the injection of a fluid of a special composition for the purpose of reducing viscosity and density of reservoir fluids, for example in order to allow them to be more pumpable to improve or allow production to surface by methods such as a downhole mechanical pump, a downhole electric submersible pump (ESP), gas lift or other such methods of artificial lift. These applications tend to be performed at moderate to high flow rates which are a fraction of the flow rates of the actual produced reservoir well fluids.

Direct Water injection—this may involve the injection of seawater or water recovered from another well into a producing reservoir in order to replenish reservoir pressures and volumes in order to assist in the production from the reservoir. This is generally performed at very high rates of flow comparable to the production flow rates that may occur form the reservoir.

In all instances of the above example fluid injection applications the line carrying the fluid to be injected must be equipped with a non-return or check valve, such that flow in only one direction is permitted. This is necessary to ensure that any fluid pressures encountered specifically in the reservoir at the point of injection shall be stopped from reverse flow to surface as a means of protecting surface equipment and facilities from the risk of reservoir fluids being delivered to these surface locations.

A check valve can take many forms. Generally, check valves include a moveable valve body or structure which cooperates with a valve seat. The valve body is lifted from the valve seat in response to flow or sufficient pressure in a forward direction, and moved and held against the valve seat in response to flow or sufficient pressure in the reverse direction. In most cases the valve body is biased towards a closed position, such that the valve body will only open when pressure in a forward direction exceeds the effect of the bias. The minimum pressure required to open the valve body is typically referred to as the cracking pressure.

The most basic is the ball or poppet design where a ball or pin (poppet) is moved to a positively closed position by the force of a spring to stop reverse flow of fluids from an outlet to inlet. In order to allow flow in the forward direction (from inlet to outlet), the inlet pressure must be pressurised to a high enough level to overcome the force of the closure spring to open the ball or pin, which will then allow fluid to forward flow.

The ball and poppet check is ideally suited to lower flow regimes such as may be found in, for example, direct chemical injection. For higher flow rates, ball and poppet checks suffer the disadvantage of having an obstruction to the direction of flow. This can lead to erosion and wear of the sealing components of the check which can then lead to the reverse flow sealing capability of the check being compromised. Also, the projection of the internal components is directly in the flow path of the fluid passing through the device which can then lead to increased pressure losses. Therefore ball and poppet checks are typically not suited to higher flow regimes.

For higher rates of flow, other forms of check tend to be used. For high flow regimes forms such as butterfly checks are used. These operate by way of one or two plates which are hinged to allow rotation into an open position to provide a large flow path for fluid passing through. The plates are returned to their closed position by springs. However, although such butterfly checks might offer the advantage of a higher flow area, they are not always suited to downhole sealing requirements due to the complex shape of the sealing plates. As such, butterfly checks are normally confined to surface applications.

An alternative but similar approach is the flapper type of check which operates by way of fluid flow moving the swing plate (flapper) about a fixed rotating axis against a closure spring. This then allows a larger flow area and reduced fluid pressure losses through the device.

For downhole applications these example forms of device generally require modification in order to be fully suitable for use in an oil/gas well environment due to aggressive fluids, elevated temperatures and the need for a long service life capability in providing a critical reverse flow protection from reservoir fluids. For low flow applications such as direct chemical injection or water de-salting ball or poppet checks may be suitable. However, for requirements where higher flow rates are required such as higher flow rate water de-salting, diluent injection and direct water injection, devices based on flapper or articulated ball devices may be preferred. However, such devices also have their limitations, such as their required size, exposure of seal surfaces to the high flow rates when opened, and the like.

Also, many known check valves are sensitive to varying flow rate situations, and may suffer problems in such varying flow rate situations. Ball and poppet checks will have a range of flow where the ball or poppet is trying to float in a partially open position. Because the ball or poppet is driven to a closure position by a return spring which opposes the path of flow, the ball or poppet can be unstable and oscillate back and forth onto its sealing region causing damage to the critical sealing area of the device.

With a swing or butterfly check a similar mode can occur where the plates of the check are partially open and exposed to the flow path and also are subject to oscillation which may damage their function as a non-return barrier protection.

Current systems may therefore not be suitable for fluid injection applications where variable flow rate requirements must be catered for while still assuring the reverse flow protective barrier is suitably protected and will operate in arduous downhole conditions for a long life span.

SUMMARY OF THE INVENTION

An aspect of the present invention relates to a flow system, comprising:

a system flow path extending from a system inlet to a system outlet;

a pressure module provided within the system flow path to establish a differential pressure between upstream and downstream sides thereof during flow from the system inlet to the system outlet;

a valve provided within the system flow path; and a valve actuator in pressure communication with the system flow path on upstream and downstream sides of the pressure module to be driven by a differential pressure established by the pressure module from a first position in which the valve is closed, to a second position in which the valve is opened.

In use, the system may facilitate flow from a fluid source to a target location. In this respect the system inlet may be configured to communicate with a fluid source, and the system outlet may be configured to communicate with a target location.

Also, during use, the valve may be actuated by a pressure differential established by the pressure module. As the pressure differential is created during flow, then the valve will thus be operated to be opened only in the event of such flow. As such, the valve may be considered to be flow actuated, based on a pressure differential created by the pressure module during flow.

It should be understood that terms such as "downstream" and "upstream" are used in a directional sense relative to the system, and in particular relative to the system flow path which extends between the system inlet and outlet. In this case the downstream direction is in a direction through the flow path from the system inlet to the system outlet, with the upstream direction opposite this. Also, a feature defined as being on an upstream side of a reference point in the system may be considered to be positioned on that side of the reference point which is closer to the system inlet along the flow path. A feature defined as being on a downstream side of a reference point may be construed accordingly.

The valve actuator may be in pressure communication with the upstream and downstream sides of the pressure module such that the pressure differential acts or is applied against the actuator to move said actuator in a direction from its first position towards its second position. That is, the pressure differential may be applied on the actuator to move in a direction to open the valve from a closed position.

The provision of the valve actuator to operate the valve may eliminate or mitigate problems associated with known valves, such as known check valves, which are operated directly by the fluid under control. For example, the use of the valve actuator which is operated by a pressure differential may permit operation of the valve based on the presence of flow, yet minimise sensitivities associated with actual flow rates. This may permit the system to be utilised in any application over any range of flow rates, from ultra small flow rates to very high flow rates. Also, the use of the actuator will positively hold the valve open, which may also assist to minimise undesired oscillations or fluttering within the valve, which could otherwise cause damage to any sealing arrangement within the valve, upset the desired control of a fluid, or the like. Further, actuating the valve on the basis of a pressure differential applied to a valve actuator may assist to ensure a desired degree of opening, such as fully opening, of the valve. Providing a desired degree of opening of the valve may assist to minimise pressure losses through the valve, any undesired modification to the pressure profile of the fluid through the system or the like.

The valve actuator may be operated by the differential pressure to fully open the valve when said actuator is in its second position. For example, the valve actuator may be configured to open the valve to its maximum extent.

The valve actuator may be movable towards the second position when the pressure differential exceeds a threshold value. Thus, upon reaching or exceeding the threshold differential pressure value the valve actuator may move towards its second position to open the valve. When the pressure differential is below the threshold value the valve actuator may remain within its first position, with the valve thus closed.

The system may comprise a valve actuator biasing arrangement for use in biasing the valve actuator in a preferred direction. The actuator biasing arrangement may be arranged to bias the valve actuator towards the first position, and thus biased in a direction in which the valve may be closed. Such an arrangement may permit the valve actuator, and in fact the valve, to operate under a normally-closed mode of operation, in that the actuator is biased against operating the valve to open. Where the valve actuator is biased towards its first position the differential pressure established by the pressure module must, at least, overcome the bias from the actuator biasing arrangement in order to move the valve actuator towards its second position and open the valve. The actuator biasing arrangement may comprise a spring, such as a coil spring, disk spring or the like. The actuator biasing arrangement may be adjustable.

The valve actuator may comprise or define an actuator piston operable by the pressure differential established by the pressure module.

The system may be arranged such that pressure upstream of the pressure module is communicated to act on the valve actuator in one direction, and pressure downstream of the pressure module is communicated to act on the valve actuator in an opposite direction. Such an arrangement may permit the valve actuator to move in accordance with the pressure differential between the upstream and downstream sides of the pressure module.

In one embodiment the system may be arranged such that pressure upstream of the pressure module is communicated to act on the valve actuator to urge said actuator from its first position towards its second position, and pressure downstream of the pressure module is communicated to act on the valve actuator to urge said actuator from its second position to its first position. In such an arrangement the pressure module may be configured to elevate the pressure on its upstream side above that on its downstream side, having the effect that the pressure differential will ultimately act to urge the valve actuator towards its second position.

The system may comprise an actuator housing, wherein the valve actuator may be mounted and moveable within said housing. The housing may define at least a portion of the system flow path. The system may comprise an actuator sealing arrangement providing sealing between the valve actuator and the actuator housing. The actuator sealing arrangement may define a dynamic sealing arrangement. This may permit sealing to be achieved during relative movement of the valve actuator and actuator housing. The actuator sealing arrangement may comprise one or more sealing members, such as one or more o-rings, non-elastomeric sealing members or the like.

The system may be arranged such that one side of the actuator sealing arrangement is in pressure communication with the system flow path on the upstream side of the pressure module, and an opposite side of the actuator sealing arrangement is in pressure communication with the system flow path on the downstream side of the pressure module. In such an arrangement the action of the differential pressure applied over the actuator sealing arrangement may urge the valve actuator to move towards its second position.

The system may comprise at least two actuator sealing arrangements providing at least two regions of sealing between the valve actuator and the actuator housing. At least two actuator sealing arrangements may define an actuator chamber, such as an annular actuator chamber, therebetween. This actuator chamber may be arranged in pressure communication with the system flow path on one of the upstream and downstream sides of the pressure module.

At least two actuator sealing arrangements may define different sealing areas. Such an arrangement may establish a differential piston area.

The valve actuator may be mounted within the system flow path. For example, the valve actuator may be mounted within a housing which defines a portion of the system flow path. This housing may also define an actuator housing. Mounting the valve actuator within the system flow path may permit direct pressure communication with the flow path on one side of the pressure module. This may minimise the requirement and complexity for pressure communication systems.

The valve actuator may be mounted within the system flow path on one of the upstream and downstream sides of the pressure module. As such, the valve actuator may be directly exposed to pressure on this same side of the pressure module.

The valve actuator may define a portion of the system flow path. The valve actuator may define a bore or bore system which defines a portion of the system flow path. In such an arrangement, fluid may flow through the valve actuator. The system may comprise an actuator chamber on an outer surface of the valve actuator, wherein said actuator chamber is isolated from a flow path, such as a bore, of the valve actuator. The actuator chamber may be defined between two sealing arrangements. Such sealing arrangements may be positioned between the valve actuator and a surrounding housing. Providing an isolated actuator chamber may permit pressure communication with the system flow path on the other side of the pressure module.

The valve actuator may be positioned externally of the flow path. For example, the valve actuator may be provided in a separate module or housing, externally of the flow path.

The valve actuator may comprise a pin. The valve actuator may comprise a sleeve. The valve actuator may comprise a tube.

The valve actuator may be in pressure communication with the flow path on one or both sides of the pressure module by direct fluid communication or exposure. That is, the valve actuator may be directly exposed to the fluid within the flow path. The valve actuator may be in pressure communication with the flow path on one or both sides of the pressure module via a pressure transfer device or assembly, such as a piston, diaphragm or the like. This may isolate or at least partially isolate the valve actuator from exposure to the fluid flowing through the system.

The system may comprise one or more pressure conduits to permit pressure communication of the flow path with the valve actuator. In some embodiments a pressure conduit may be defined within a housing, such as by a bore within a housing, which forms part of the system. In some embodiments a pressure conduit may be defined separately from a housing which forms part of the system, such as via a tube, pipe, hose or the like.

The valve may comprise or function as a non-return valve for permitting flow only in the direction from the system inlet to the system outlet. As such, the valve may prevent, or check, flow from the system outlet to the system inlet. In such an arrangement the flow from the system inlet to the system outlet may be considered to be in a forward direction, and any flow from the system outlet to the system inlet may be in a reverse direction. The valve may therefore prevent flow in this reverse direction. The valve may comprise or define a check valve.

The valve may be operable to be positively closed by any reverse flow. As such, the valve may be operable to be opened by the valve actuator, and closed by action of fluid downstream of the system.

In this respect, if the valve is open and downstream pressure rises, this rise in pressure shall reach a level where the valve returns to its closed position. Therefore, this approach provides a non-return check, regardless of the form of the check system used, which will close either if the upstream pressure is not sufficient to allow forward flow, or if the downstream pressure rises to near, equal or above the upstream inlet pressure.

This may ensure that if a sufficient inlet pressure is applied, regardless of flow rates, the valve will open to a fully open position reducing pressure losses locally and protecting the valve components from wear and erosion.

The valve may comprise a valve biasing arrangement. The valve biasing arrangement may be configured to bias the valve towards a closed position. In such an arrangement the valve actuator may open the valve against the bias of the valve biasing arrangement. The valve biasing arrangement may comprise a spring, for example.

In some embodiments the valve biasing arrangement may function to bias the valve actuator, for example in a direction to move the valve actuator towards its first position. Such an arrangement may eliminate a requirement to provide a separate actuator biasing arrangement.

In some embodiments the system may comprise an actuator biasing arrangement configured to bias the valve actuator in a desired direction. Such an actuator biasing arrangement may function to bias the valve in a desired direction, such as towards a closed position. Such an arrangement may eliminate a requirement to provide a separate valve biasing arrangement.

The valve may comprise a valve member to be moved by the valve actuator between open and closed positions. The use of the valve actuator to operate the valve member may eliminate or mitigate any problems associated with valve members which are directly operated by the fluid under control, particularly directly operated by the fluid under control to both open and close the valve member.

The valve may comprise a valve seal arrangement to cooperate with the valve member to permit sealing when the valve is closed. The valve seal arrangement may be provided on a valve seat. The use of the valve actuator to open and hold open the valve member, rather than using the flow directly, may minimise problems associated with oscillation of valve members, which may assist to protect any associated valve seal arrangement.

The valve actuator may extend at least partially through the valve when said valve actuator is moved towards its second position. In one embodiment the valve actuator may extend through a valve seat portion of the valve when said valve actuator is moved towards its second position. In such an arrangement the valve actuator, which may be in the form of a sleeve or tube, may define a portion of the system flow path. In this arrangement the valve actuator may at least partially isolate the valve seat from fluid flow when said valve actuator is moved towards its second position to open the valve. This may function to protect the valve seat from fluid flow. Further, the valve actuator may at least partially isolate a valve member from fluid flow when said valve actuator is moved towards its second position.

The valve actuator may be provided separately from the valve body. The valve actuator may be separately formed and subsequently arranged, engaged or coupled relative to a valve member.

The valve actuator may be arranged to abut a valve member. In such an arrangement the valve actuator may be operable to move the valve member by pushing said valve member.

The valve actuator may be coupled or secured to a valve member, for example by threaded coupling, welding, interference fitting, or the like.

The valve actuator may be integrally formed with a valve member.

The valve member may define a linear valve member. That is, the valve member may be operable to be moved linearly to selectively open and close the valve. In such an arrangement the valve actuator may be configured to initiate linear motion of the valve member. In such an arrangement the valve may comprise a ball, poppet, disk, needle, plunger, gate or the like.

The valve member may define a rotary valve member. That is, the valve member may be operable to be moved rotationally to selectively open and close the valve. In such an arrangement the valve actuator may be configured to initiate rotary motion of the valve member. In such an arrangement the valve may comprise a ball valve member, a rotatable disk or the like.

The valve member may comprise a rotatable ball defining a through bore, wherein when in an open position the ball is rotatably positioned to align the bore with the flow path, and when in a closed position the bore is misaligned. By use of a valve actuator which is operated by a differential pressure created within a fluid flowing through the system may permit such a rotatable valve to be utilised, and, for example, to function as a check valve.

The valve member may define a pivoting valve member. That is, the valve member may be operable to pivot about a pivot axis to selectively open and close the valve. In such an arrangement the valve actuator may be configured to initiate pivoting motion of the valve member. In such an arrangement the valve may comprise a butterfly valve member, flapper valve member or the like.

The valve member may comprise a unitary component.

The valve member may comprise multiple components.

The system may comprise a valve interface arrangement configured to permit the valve actuator to operate the valve.

The valve interface arrangement may be interposed between the valve actuator and the valve. The valve interface arrangement may be interposed between the valve actuator and a valve member.

The valve interface arrangement may be configured to convert one motion of the valve actuator to a different motion of a valve member. In one embodiment the interface arrangement may be operable to convert linear motion of the valve actuator to rotational motion of a valve member. The interface arrangement may comprise an articulation arm arrangement. The interface arrangement may comprise a rack and pinion arrangement. The interface arrangement may comprise a pin and slot, such as a J-slot mechanism or arrangement.

The valve may be positioned on the downstream side of the pressure module.

Alternatively, the valve may be positioned on the upstream side of the pressure module.

The valve may be provided separately from the pressure module. For example, the valve may be provided in a separate valve module or housing. Alternatively, the valve and the pressure module may be provided within a common module, such as within a common housing.

The valve may comprise a downhole valve, such as a valve associated with a downhole system. The valve may comprise a Sub-Surface Safety Valve (SSSV).

The pressure module may be configured to provide a differential pressure which is sufficient to operate the valve actuator. Thus, when the pressure module is operating to provide a pressure differential, the actuator will be moved to its second position.

In some embodiments the pressure module may be configured to provide a minimum pressure differential during any flow necessary to operate the valve actuator, such that any operational state of the pressure module will cause the valve actuator to be urged towards its second position and operate the valve.

The pressure module may be provided exclusively to operate the valve actuator.

The pressure module may provide an active function in addition to operating the valve actuator. For example, the pressure module may be configured to provide a pressure differential which may provide a function, operation or advantage beyond only operating the valve actuator.

In some embodiments the pressure module may be arranged in accordance with the apparatus and devices disclosed in WO 2011/157985 or WO 2012/136966, the disclosure of which is incorporated herein by reference.

The pressure module may be configured to maintain the pressure of the upstream side of the pressure module at a defined value below or above the downstream side.

The pressure module may be operable during flow to establish a greater fluid pressure in the system flow path on an upstream side of the pressure module than on a downstream side. Such an arrangement may permit the inlet side of the flow system to be maintained at a greater pressure than the outlet side.

The pressure module may be configured to provide a fixed pressure differential between the upstream and downstream sides of the pressure module.

The pressure module may be configured to provide a variable pressure differential between the upstream and downstream side of the pressure module. Such an arrangement may be configured to provide a fixed pressure on one side of the pressure module, irrespective of variations in pressure on the other side.

The pressure module may comprise a back-pressure module, configured to establish a back-pressure within the system flow path on the upstream side of the pressure module.

The pressure module may comprise a flow restriction within the system flow path. The flow restriction may be fixed. Alternatively, the flow restriction may be variable.

The upstream side of the pressure module may define a source pressure, and the downstream side may define a target pressure. In some embodiments the pressure module may be configured to control the source pressure relative to the target pressure.

Establishing/maintaining a greater pressure on the upstream side of the pressure module, for example by a back-pressure, may assist to prevent a phenomenon known as "U-Tube" hydrostatic fall through, especially where the system inlet is coupled to a supply conduit which extends above, for example significantly above the flow system. Such a scenario may be present when the flow system is positioned downhole within a well. In such an instance there will be a hydrostatic pressure gradient within the supply conduit due to gravity. This pressure gradient is a function of the true vertical height (depth of the well) known as the TVD (True Vertical Depth) and the density of the fluid. As depth (height) increases, the pressure gradient will linearly increase.

In some instances, for example where a pump is used in the region of a target location, it is possible that the pressure at the target location may be drawn down. In doing this there will be a pressure at the target location which may be less than the hydrostatic gradient in the supply conduit.

The fluid in the supply conduit will have a tendency to reach equilibrium and will follow the laws of fluid mechanics associated with a "U Tube" where the fluid levels will balance in equilibrium. This means the fluid in the supply conduit will "fall through" to a point where the fluid column height in the supply conduit will balance the pressure at the target location. This therefore potentially leaves a portion of the supply conduit in a vacuum or near vacuum.

The pressure module may function to increase and maintain the pressure in the supply conduit above the target location and thus resists the tendency for the fluid column in the supply conduit to "fall through" which may lead to a vacuum in the upper portion of the capillary injection line.

The flow system may be configured as an injection system, for use during injection of a fluid from a source to a target.

The flow system may be configured as a downhole injection system, for use during injection of a fluid into a downhole environment, such as into a portion of a downhole completion, a subterranean formation or the like.

The flow system may be configured for use in chemical injection.

The flow system may be configured for use in water de-salting injection.

The flow system may be configured for use in diluent injection.

The flow system may be configured for use in direct water injection

An aspect of the present invention relates to a method for flow control, comprising:

delivering a fluid to an inlet of a flow path;

permitting the fluid to flow through a pressure module to create a pressure differential within the fluid on upstream and downstream sides of the pressure module; and controlling a valve actuator with the pressure differential such that in response to the pressure differential the valve actuator is urged from a first position in which a valve within the flow path is closed, to a second position in which the valve is opened The method may be performed using a flow system according to any other aspect.

An aspect of the present invention relates to a downhole injection system. Such an injection system may include all or part of a flow system according to any other aspect.

An aspect of the present invention relates to a non-return valve system.

An aspect of the present invention relates to a valve system, comprising:

a pressure module defining an inlet and an outlet and a flow path extending therebetween, and including a flow restriction within the flow path for establishing a pressure differential between the inlet and the outlet; and a valve actuator in pressure communication with the inlet and outlet of the pressure module to permit said valve actuator to be moved in accordance with a pressure differential established by said pressure module to operate a valve member.

An aspect of the present invention relates to an injection system, comprising:

a pressure module configured to establish a pressure differential in a fluid flowing through the injection system in a forward direction;

a non-return valve for preventing flow through the injection system in a reverse direction, wherein the non return valve is operated by a pressure differential established by the pressure module.

It should be understood that the features defined in relation to one aspect may be applied to any other aspect.

BRIEF DESCRIPTION OF THE DRAWINGS

These and other aspects of the present invention will now be described, by way of example only, with reference to the accompanying drawings, in which:

FIGS. 2A and 2B are cross-sectional views of a flow system, specifically an injection apparatus, in accordance with an embodiment of the present invention, wherein FIG. 2A illustrates the system in a closed configuration, and FIG. 2B illustrates the system in an open and flowing configuration;

FIGS. 5A and 5B are cross-sectional views of a flow system, specifically an injection apparatus, in accordance with an alternative embodiment of the present invention, wherein FIG. 5A illustrates the system in a closed configuration, and FIG. 5B illustrates the system in an open and flowing configuration;

FIGS. 6A and 6B are cross-sectional views of a flow system, specifically an injection apparatus, in accordance with another embodiment of the present invention, wherein FIG. 6A illustrates the system in a closed configuration, and FIG. 6B illustrates the system in an open and flowing configuration;

FIGS. 7A and 7B are cross-sectional views of a flow system, specifically an injection apparatus, in accordance with a further embodiment of the present invention, wherein FIG. 7A illustrates the system in a closed configuration, and FIG. 7B illustrates the system in an open and flowing configuration;

FIGS. 8A and 8B are cross-sectional views of a flow system, specifically an injection apparatus, in accordance with an alternative embodiment of the present invention, wherein FIG. 8A illustrates the system in a closed configuration, and FIG. 8B illustrates the system in an open and flowing configuration;

FIGS. 9A and 9B are cross-sectional views of a flow system, specifically an injection apparatus, in accordance with another embodiment of the present invention, wherein FIG. 9A illustrates the system in a closed configuration, and FIG. 9B illustrates the system in an open and flowing configuration;

FIGS. 10A and 10B are cross-sectional views of a flow system, specifically an injection apparatus, in accordance with another embodiment of the present invention, wherein FIG. 10A illustrates the system in a closed configuration, and FIG. 10B illustrates the system in an open and flowing configuration; and FIGS. 11A and 11B are cross-sectional views of a flow system, specifically an injection apparatus, in accordance with an embodiment of the present invention, wherein FIG. 11A illustrates the system in a closed configuration, and FIG. 11B illustrates the system in an open and flowing configuration.

DETAILED DESCRIPTION OF THE DRAWINGS

Figure 1:
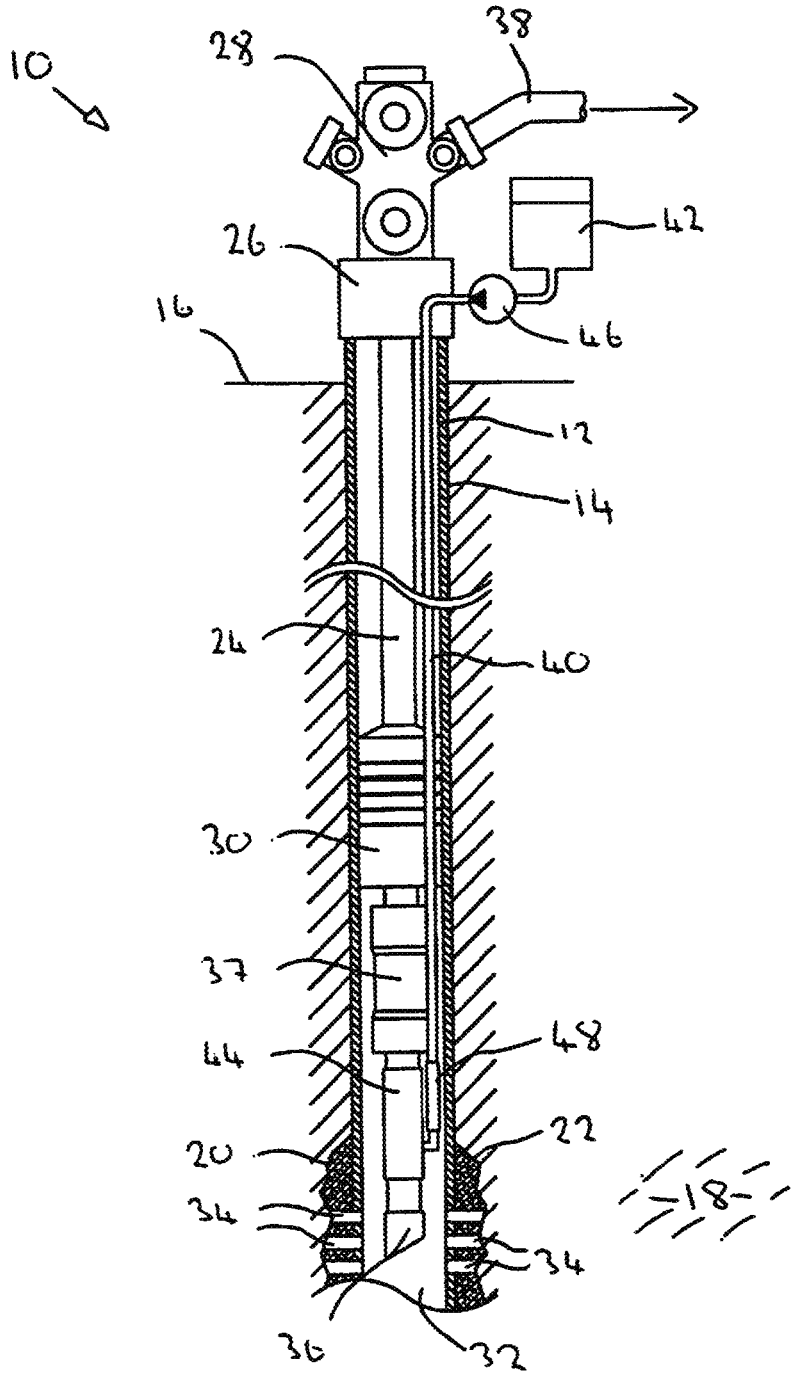
FIG. 1 is a diagrammatic illustration of a wellbore system which includes injection capabilities.

A typical wellbore completion installation with injection capabilities is diagrammatically illustrated in FIG. 1. The wellbore, generally identified by reference numeral 10, comprises a casing string 12 located within a drilled bore 14 which extends from surface 16 to intercept a hydrocarbon bearing formation 18. A lower annulus area 20 defined between the casing 12 and bore 14 may be filled with cement 22 for purposes of support and sealing. A production tubing string 24 extends into the casing 12 from a wellhead 26 and production tree 28. A lower end of the production tubing string 24 is sealed against the casing 12 with a production packer 30 to isolate a producing zone 32. A number of perforations 34 are established through the casing 12 and cement 22 to establish fluid communication between the casing 12 and the formation 18. Hydrocarbons may then be permitted to flow into the casing 12 at the producing zone 32 and then into the production tubing 24 via inlet 36 to be produced to surface. Artificial lift equipment, such as an electric submersible pump (ESP) 37 may optionally be installed inline with the production tubing 24 as part of the completion to assist production to surface. The production tree 28 may provide the necessary pressure barriers and provides a production outlet 38 from which produced hydrocarbons may be delivered to a production facility (not shown), for example.

A small bore injection line or conduit 40, which is often referred to as a capillary line, runs alongside the production tubing 24 from a surface located injection fluid source 42 to a downhole target location, which in the illustrated example is a lower end of the production tubing 24, below the ESP 37. The production tubing 24 may include an optional injection mandrel 44. An injection pump 46 is located at a topside location to facilitate injection of the injection fluid 42.

An injection valve 48 is located in a lower region of the injection line 40 and functions to permit fluid injection into the production tubing 24, in some cases preferentially at a constant injection rate, while preventing reverse flow back into the injection line 40, for example via a non-return or check valve.

In some circumstances the pressure at the target injection location may fall below the hydrostatic pressure within the injection line 40, which may be the case in very deep wells and/or where the ESP 37 is operating and thus drawing down the pressure at the target location. In such instances undesirable flow or cascading of injection fluid may occur until the hydrostatic pressure within the injection line 40 is in equilibrium with the target location. This effect may be termed "hydrostatic fall-through". If the injection fluid is not continuously replenished, or not replenished as quickly as the injection fluid cascades through the valve 48, then the result will be the creation of low, vacuum or near vacuum pressures in the upper region of the injection line 40. Such a vacuum may present the injection line 40 to adverse mechanical forces and stresses, such as radial collapse forces. Furthermore, the established vacuum may be defined by a pressure which is lower than the vapour pressure of the injection fluid, thus causing the injection fluid to boil. This may be compounded by the effect of the increased temperatures associated with wellbore environments. The consequence of vacuum occurrence in chemical injection lines is that the original fluid may not be able to retain its intended state and the fluid carrier will boil off. This has the potential of many adverse effects, such as solid depositing, viscosity change, crystal formation, waxing, partial or full solidification, and generally changes within the fluid causing loss of effectiveness of the injection chemical, and the like.

In the system 10 of FIG. 1 injection is provided via a small bore injection line 40. Injection may be provided to deliver a diluent to reduce the viscosity of the wellbore fluids and permit easier lifting by the ESP 37. In other cases injection may deliver treating chemicals into the wellbore system, for example to inhibit scale and the like.

In some instances, however, very high flow rate injection is necessary, for example for water injection into the formation 18. In such cases a small bore injection line 40 may be inappropriate to accommodate the necessary flow rates. As such, large bore systems may be utilised. However, even in such large bore systems injection valves are still typically used, for example to check any flow in a reverse direction.

Embodiments of the present invention provide flow systems, for example in the form of an injection apparatus, which may be suitable for use in injection applications and may facilitate any flow rate, from very small flow rates such as might be the case in chemical injection, to very high flow rates such as might be the case in water injection.

Figure 2A:
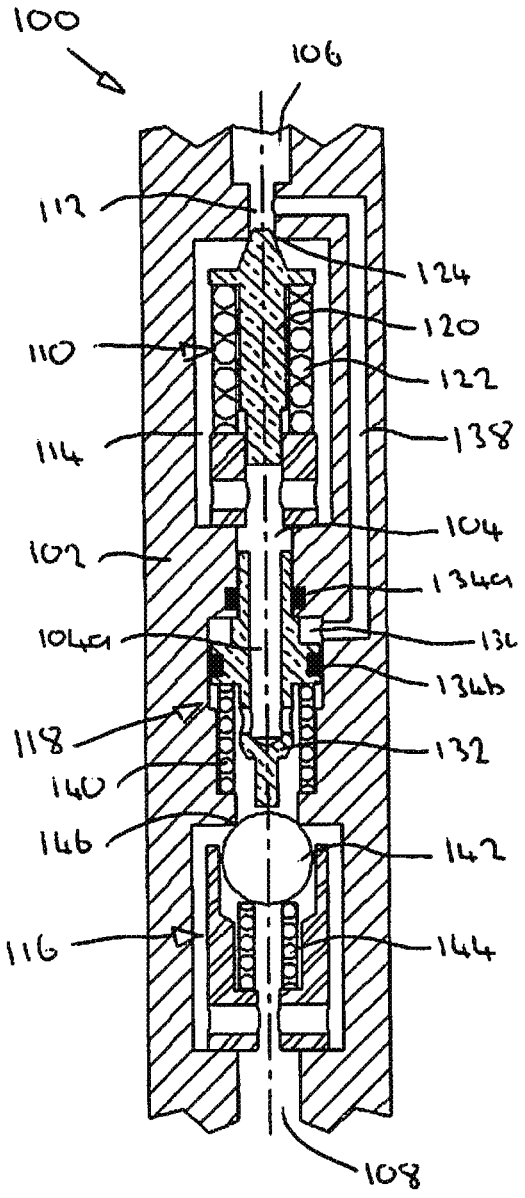
Figure 2B:
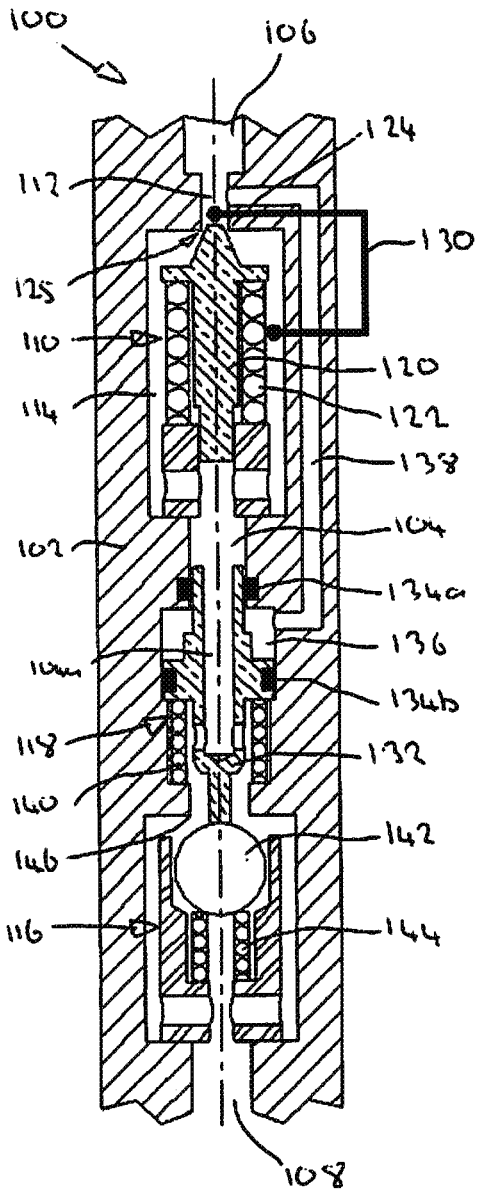

FIGS. 2A and 2B are cross-sectional views of a flow system, specifically an injection apparatus, generally identified by reference numeral 100, in accordance with an embodiment of the present invention. In FIG. 2A the apparatus 100 is shown in a closed configuration, and in FIG. 2B the apparatus 10 is in an open or flowing configuration.

In the embodiment shown the apparatus 100 includes a common housing 102 (either as a complete integrated housing or by separate housings or modules directly coupled together) and defines a system flow path 104 which extends between a system inlet 106 and a system outlet 108. The inlet 106 may be coupled to a fluid source, for example via a conduit (not shown), and the outlet 108 may be coupled or presented in communication with a target location, such that fluid from a source may be delivered from a source to a target via the flow path 104 of the apparatus. In this respect, as will be described below, the apparatus may provide a degree of control of the fluid.

The apparatus 100 comprises a pressure module 110 which, as will be described in more detail below, functions to establish a pressure differential in the flow path 104 between an upstream side 112 and a downstream side 114 of the pressure module 110.

The apparatus 100 also comprises a valve 116 provided within the flow path 104. In the embodiment shown the valve 116 is a non-return or check valve and is mounted on the downstream side of the pressure module 110. The valve 116 functions to permit flow in a forward direction from the inlet 106 to the outlet 108, and prevent flow in a reverse direction from the outlet 108 to the inlet 106.

The apparatus 100 also comprises a valve actuator 118 provided within the flow path 104. As will be described in more detail below, the valve actuator 118 is operated by the pressure differential established by the pressure module 110 to control the valve 116. More particularly, the valve actuator 118 is in pressure communication with the flow path 104 on upstream 112 and downstream 114 sides of the pressure module 110 to be driven by the differential pressure established by the pressure module 110 from a first position in which the valve 116 is closed, to a second position in which the valve 116 is opened.

The pressure module 110 comprises a pin 120 which is biased by a spring 122 towards a closed position in which the pin 120 sealingly engages a seat 124 to prevent flow through the flow path 104. To permit injection the fluid pressure at the inlet 106 must establish a downward force on the pin 120 which exceeds the combined force of the spring 122 and the pressure at the outlet 108, which act on the pin 120 in the opposing direction. When the inlet pressure is sufficient the pin 120 will be lifted from the seat 124, as shown in FIG. 2B, and in this configuration the pin 120 and seat 124 will define a flow restriction 125 within the flow path 104. This flow restriction 125 will therefore establish a back-pressure on the upstream side 112 of the pressure module 110. When in equilibrium, the force established by pressure on the upstream side 112 of the pressure module 110 will balance the combined force established by the spring 122 and the pressure on the downstream side 114 of the pressure module 110 (which can be considered to be the same pressure at the outlet 108). Accordingly, the effect of the pressure module 110 is to maintain the pressure at the inlet 106 at a fixed pressure differential (represented by line 130 in FIG. 2B) above the pressure at the outlet 108. This pressure differential will be dictated primarily by the force of the spring 122.

Figure 3:
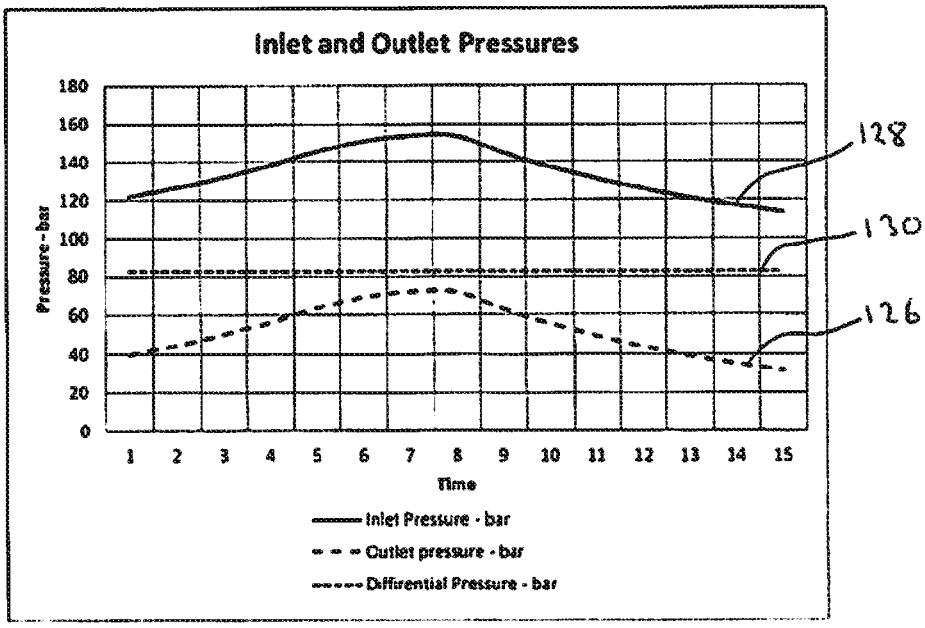
FIG. 3 is a diagrammatic illustration of a possible differential pressure profile provided by a pressure module of a flow system.

If the pressure at either the inlet 106 or the outlet 108 should vary, the pin 120 will move accordingly to adjust the flow restriction and continuously seek force equilibrium, thus maintaining the pressure at the inlet 106 a fixed differential above the pressure at the outlet 108. An example pressure profile associated with the operation of the apparatus 100 is shown in FIG. 3, reference to which is additionally made. In this respect the pressure 126 at the outlet 108 of the apparatus 100 is seen to vary over time. Operation of the pressure module 110 may permit the pressure 128 at the inlet 106 to track above the pressure at the outlet 108 by a fixed differential 130. Such an arrangement may assist to prevent hydrostatic fall through and cascading of injection fluid from a supply conduit through the apparatus 100.

The valve actuator 118 comprises an axially moveable actuating pin 132 mounted within the housing 102, in-line with the flow path 104. The actuating pin 132 defines a fluid bore 104*a* which forms part of the flow path 104 of the apparatus 100. As such, flow is permitted through the actuating pin 132. As will be described below, the actuating pin 132 is movable axially within the housing in response to a pressure differential created by the pressure module 110 such that the pin 132 may selectively open the valve 116.

The valve actuator 118 includes first and second sealing arrangements 134*a*, 134*b* axially arranged on the actuating pin 132 to establish sealing with the housing 102. In the illustrated exemplary embodiment sealing arrangement 134*b* defines a larger sealing area than sealing arrangement 134*a*.

The sealing arrangements 134*a*, 134*b* define an actuator chamber 136 therebetween, wherein the chamber 136 is isolated from the flow path 104 on the downstream side 114 of the pressure module 110. The chamber 136 is presented in pressure communication with the upstream side 112 of the pressure module 110 via a bore conduit 138.

During use, pressure from the upstream side 112 of the pressure module 110 will act within the actuator chamber 136 over the sealing arrangements 134*a*, 134*b*. Due to the differential area of the sealing arrangements 134*a*, 134*b* the upstream pressure within the chamber 136 will act to urge the actuator pin 132 in a downstream direction (which is in a direction to open the valve 116). Further, as the valve actuator is positioned within the flow path 104 on the downstream side 114 of the pressure module 110, fluid pressure on this downstream side 114 will also act on the sealing arrangements 134*a*, 134*b*, and in view of the differential sealing area the downstream pressure will act to urge the actuator pin 132 in an upstream direction (which is in a direction to close the valve 116). Accordingly, movement of the actuator pin 132 will depend on the presence of a pressure differential between upstream and downstream sides 112, 114 of the pressure module 110.

The valve actuator 118 further includes an actuator biasing spring 140 which acts on the actuator pin 132 in an upstream direction, which permits the valve 116 to close. Accordingly, to achieve movement of the actuator pin 132 in the downstream direction the upstream pressure acting in the chamber 136 must exceed the combined effect of the downstream pressure and the action of the spring 140. As the upstream and downstream pressures effectively act over the same differential sealing area, the spring 140 therefore functions to dictate the minimum required pressure differential to operate the valve actuator 118.

The valve 116 in the example embodiment is a ball-type check valve and includes a ball 142 which is mounted on a spring 144. The spring 144 acts to push the ball 142 onto a seat 146, and thus biases the ball 142 towards a closed position.

In use, for example during commissioning and subsequent injection, the outlet 108 may be coupled to a target location and the inlet 106 may be coupled to a fluid source. Under a zero or near zero pressure conditions the pin 120 of the pressure module will be closed by action of its spring 122, the actuator pin 132 of the valve actuator 118 will be in an upstream position by action of its spring 140, and similarly the ball 142 of the valve 116 will be closed by action of its spring 144. In this case the apparatus may be considered to be normally closed, as shown in FIG. 2A.

To initiate flow the pressure at the inlet 106 will require to be elevated (or in fact outlet pressure could be reduced), for example by use of a pump, until the pin 120 of the pressure module 110 may be lifted from its seat 124 to create the flow restriction 125. Once the pressure module 110 is operating a pressure differential will be established, such that the pressure on the upstream side 112 will exceed the pressure on the downstream side 114. This pressure differential may be applied on the actuator pin 132 of the valve actuator 118, as described above, to cause said pin 132 to be urged in a downstream direction. The actuator pin 132 may then directly abut and push against the ball 142 of the valve 116, lifting this from its seat 146. In this configuration the apparatus 100 may be configured for injection, as shown in FIG. 2B.

In the embodiment illustrated in FIGS. 2A and 2B the pressure module 110 is configured to provide a fixed pressure differential, as illustrated in FIG. 3. In this respect, regardless of associated flow rates, this pressure differential should be present whenever there is forward flow. Accordingly, the valve actuator 118 should be operated by this constant pressure differential. Also, the various components, such as the actuator spring 118 and valve spring 144 may be configured in such a way that guarantees the actuator pin 132 will always move in a downstream direction to open the valve whenever said pressure differential is present, and thus when flow exists in a forward direction. This effect may permit the apparatus 100 to operate as a non-return apparatus.

If downstream pressure rises, this rise in pressure may reach a level where, with the assistance of the closure springs, the ball 142 shall return to its closed position thus closing the apparatus 100. Therefore this approach provides a non-return check, regardless of the form of the check system used, which will close either if the upstream pressure is not sufficient to allow forward flow, and/or if the downstream pressure rises to near, equal or above the upstream inlet pressure.

This may ensure that if a sufficient inlet pressure is applied, regardless of flow rates, the valve 116 shall open to a fully open position reducing pressure losses locally and protecting the valve components from wear and erosion.

Figure 4:
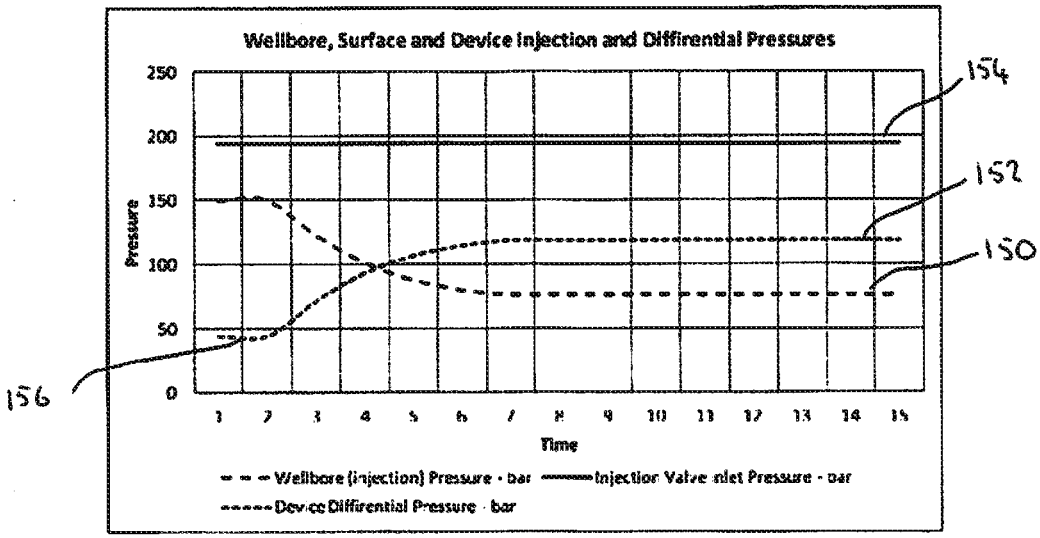
FIG. 4 is a diagrammatic illustration of another possible differential pressure profile provided by a pressure module of a flow system.

Although the embodiment of FIGS. 2A and 2B operates with a fixed pressure differential from the pressure module 110, in other embodiments a variable pressure differential may be provided. This is illustrated in the exemplary pressure profile plot of FIG. 4. In this case, as outlet pressure 150 varies over time, the pressure differential 152 may also vary, for example to maintain the inlet pressure 154 at a constant value. In this case, any device which provides the pressure profile of FIG. 4 will be configured to permit operation of a valve even when exposed to the minimum pressure differential 156.

Figure 5A:
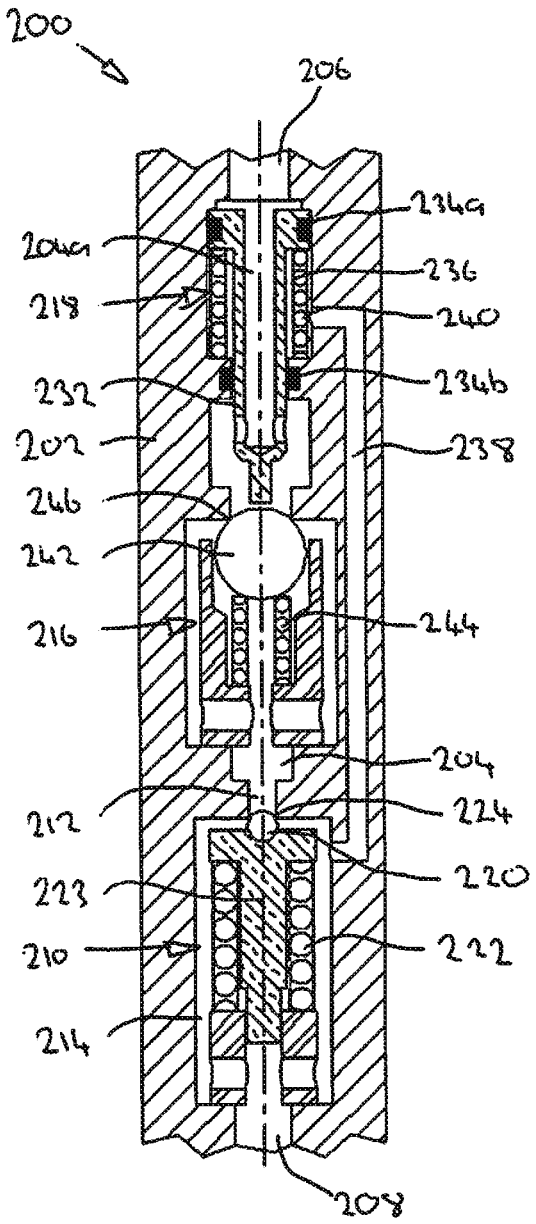
Figure 5B:
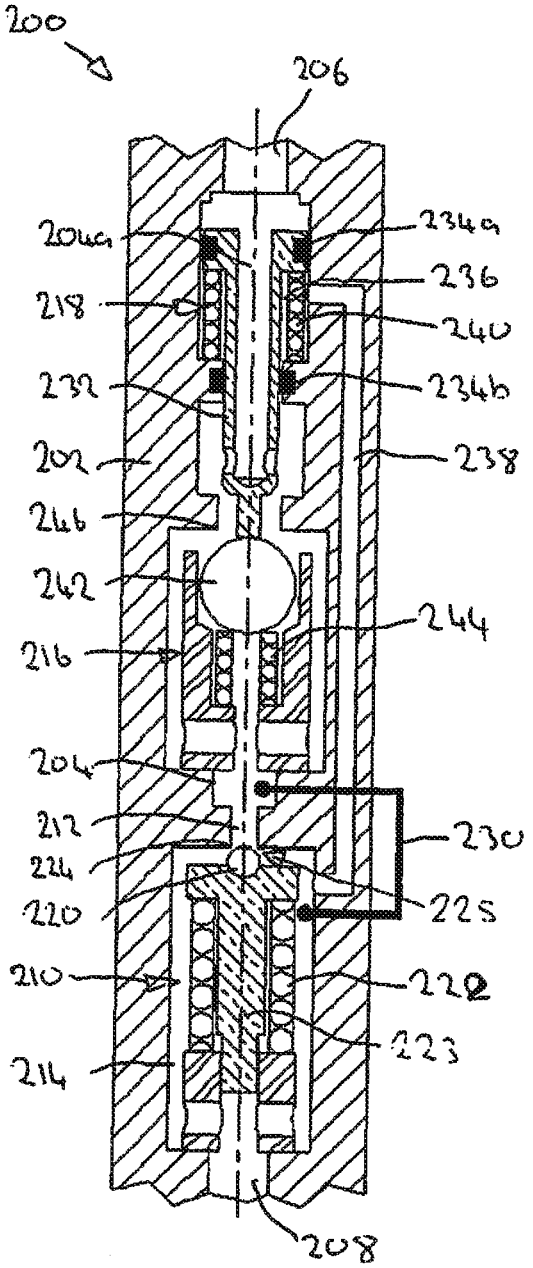

In the embodiment shown in FIGS. 2A and 2B the valve 116 is positioned on the downstream side of the pressure module 110. However, in other embodiments the valve may be positioned on the upstream side of the pressure module, as illustrated in the alternative embodiment shown in FIGS. 5A and 5B, reference to which is now made. FIG. 5A shows the apparatus 200 of this embodiment in a closed configuration, and FIG. 5B shows the apparatus 200 in an open or flowing configuration.

The apparatus 200 is generally similar to that apparatus 100 of FIGS. 2A and 2B, and as such like features share like reference numerals, incremented by 100. As such, apparatus 200 includes a housing 202 with a flow path 204 extending between an inlet 206 and an outlet 208. A pressure module 210 is mounted within the flow path 204 and functions to provide a pressure differential 230 (FIG. 5B) between an upstream side 212 and a downstream side 214 of the pressure module 210. In the present embodiment the pressure module includes a ball 220 which is biased by a spring 222 (acting via a mounting pin 223) towards engagement with a seat 224. When the ball 220 is lifted from the seat 224 a flow restriction 225 (FIG. 5B) is created, which establishes the pressure differential.

The valve 216 includes a ball 242 which is urged by a spring 244 towards engagement with a valve seat 246.

The valve actuator 210 includes an actuator pin 232 which is mounted within the housing 202 in-line with the flow path 204, wherein the pin 232 defines a central bore 204*a* which defines part of the flow path 204. The valve actuator 218 includes two sealing arrangements 234*a*, 234*b* mounted externally of the pin 232 to provide dynamic sealing within the housing 202. An actuator chamber 236 is defined between the sealing arrangements 234*a*, 234*b* and is in pressure communication with the downstream side 214 of the pressure module via bore 238. The sealing arrangements 234*a*, 234*b* define different sealing areas such that downstream pressure acting within the chamber 236 will urge the pin 232 in an upstream direction (to permit the valve 216 to close). Further, the sealing arrangements 234*a*, 234*b* are each exposed the upstream pressure within the flow path 204, and the differential seal area permits this upstream pressure to urge the pin 232 in a downstream direction (to permit the valve 216 to be opened).

The valve actuator 218 also comprises a spring 240 which acts to urge the actuator pin 232 in an upstream direction. Accordingly, in a similar manner to the apparatus 100 of FIGS. 2A and 2B, in the present apparatus 200 the actuator pin 232 will move in a downstream direction to lift the ball 242 from its seat 246 when the upstream pressure exceeds the downstream pressure and the effect of the spring 240 (and also the valve spring 244).

Figure 6A:
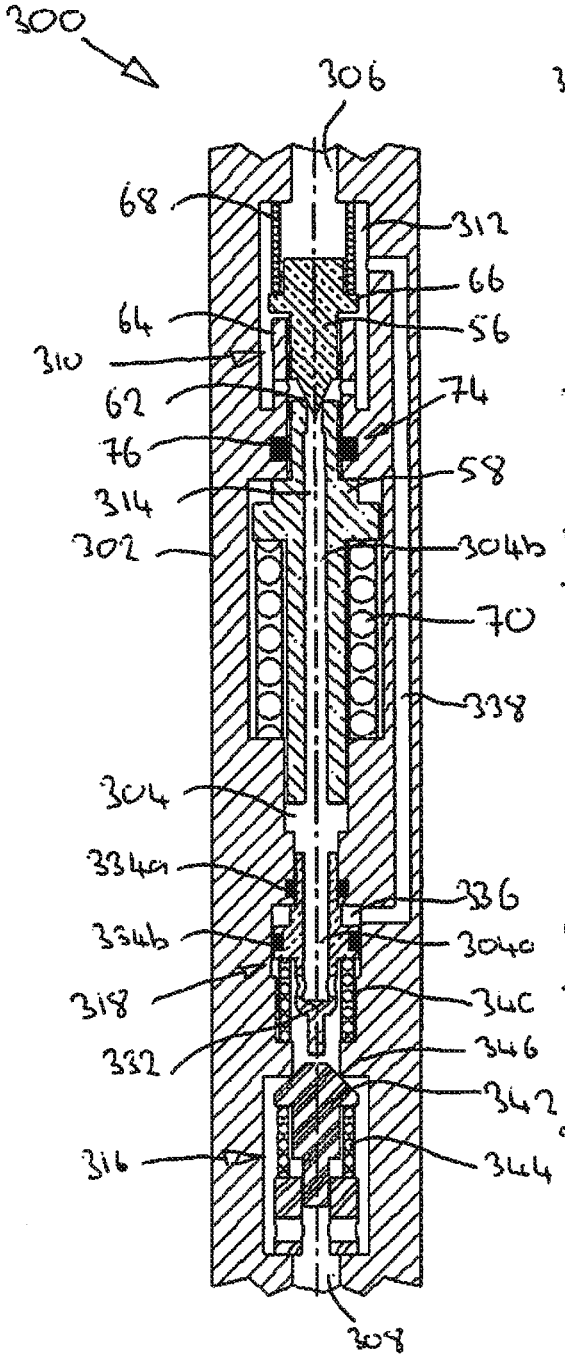
Figure 6B:
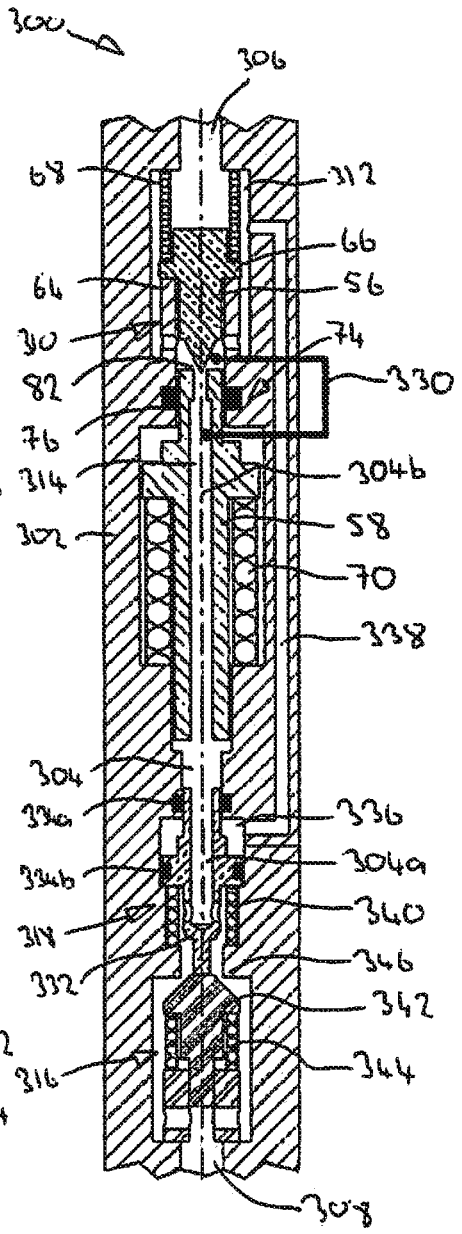

An alternative embodiment of a flow system, specifically an injection apparatus, generally identified by reference number 300, is shown in FIGS. 6A and 6B, wherein the apparatus 300 is shown in a closed configuration in FIG. 6A, and in an open or flowing condition in FIG. 6B. The present apparatus 300 is similar in many respects to apparatus 100 of FIGS. 2A and 2B and as such like features share like reference numerals, incremented by 200.

The apparatus 300 includes a housing 302 with a flow path 304 extending between nn inlet 306 and an outlet 308. A pressure module 310 is mounted within the flow path 304 and is operational to develop a pressure differential 330 (FIG. 6B) between upstream and downstream sides 312, 314 of the pressure module 310.

The apparatus 300 further comprises a valve 316 and a valve actuator 318. The valve 316 and valve actuator are configured similarly to those shown in FIGS. 2A and 2B, and as such no further description shall be given, except to say that the valve 316 includes a poppet 342 rather than a ball.

The principal difference between the present apparatus 300 and the apparatus 100 of FIGS. 2A and 2B is the configuration of the pressure module 310, which will now be described.

The pressure module 310 comprises first and second valve members 56, 58 which are both arranged for movement within the housing 302. In the embodiment shown the first valve member 56 is provided in the form of a pin and defines a valve body member, and the second valve member 58 is provided, generally, in the form of a cylinder and defines a valve seat member. The second valve member 58 defines a flow path 304*b* therethrough which forms part of the flow path 304 through the housing 302. When the first and second valve members 56, 58 are engaged, as illustrated in FIG. 6A, the pressure module 310 is configured to be closed to prevent flow. When the first and second valve members 56, 58 are engaged a seal area 62 is defined.

The pressure module includes a limiting arrangement which is configured to limit movement of the first valve member 56. Specifically, the pressure module 310 includes a limiting feature 64 fixed relative to the housing 302, and a corresponding limiting feature 66 fixed relative to the first valve member 56. In the arrangement shown in FIG. 6A when the first and second valve members 56, 58 are engaged, the corresponding limiting features 64, 66 are separated such that inlet fluid pressure may act over the seal area 62 thus forcing the first and second valve members 56, 58 together to assist sealing therebetween.

Furthermore, an optional spring 68 is provided which also acts to bias the first valve member 56 against the second valve member 58.

An actuator spring 70 is provided which acts on the second valve member 58 to bias said member 58 in a direction to engage the first valve member 56. Furthermore, the second valve member 58 defines a piston arrangement 74 which is sealed relative to the housing 302, in the present embodiment using a seal 76, wherein an upstream side of the seal 76 is exposed to upstream pressure, and a downstream side is exposed to downstream pressure. Accordingly, a net pressure force will be applied on the second valve assembly 58 in accordance with any differential between the upstream and downstream pressures. As the second valve member 58 is arranged to be actuated by various forces (pressure and spring forces), said member 58 may be defined as an actuator member.

Movement of the second valve member 58 is initiated to disengage the valve members 56, 58, to configure the pressure module in an open position to permit flow through the flow path 302, as illustrated in FIG. 6B. Such movement is initiated when the upstream pressure is of a sufficient magnitude to apply a force on the piston arrangement 74 to overcome the corresponding force applied by downstream pressure in addition to the force applied by the spring 70. In the present embodiment as the seal 76 presents a common area on both sides of the piston arrangement 74 such that the second valve member 58 will be moved in a direction to open the valve assembly 54 when the upstream pressure exceeds the downstream pressure by an amount proportional to the force of the spring 70. Accordingly, the pressure rating of the apparatus 300 may be set in accordance with the spring 70. It is recognised that a compression spring will generate a return force which is proportional to the length of compression. However, in typical operations the magnitude of compression of the spring may be considered to be sufficiently small that the change in spring force may be negligible. However, in other operations with large spring compression this may be accounted for.

During initial movement of the second valve member 58, both members 56, 58 will remain engaged by virtue of upstream pressure acting over seal area 62, in addition to the action of the spring 68. Such an arrangement will assist in maintaining sealing between the members 56, 58. Engagement will persist until the corresponding limiting features 64, 66 are brought together, thus permitting further movement of the second valve member 58 to cause disengagement, as shown in FIG. 3B. Such disengagement defines a flow passage 82 between the first and second members 56, 58, wherein the flow passage provides a restriction to flow. This restriction therefore establishes a back pressure on the upstream side 312 of the pressure module, thus functioning to maintain the upstream pressure above the downstream pressure. Further, due to the effect of the piston arrangement 74 and actuator spring 70, the flow passage 82 will be continuously adjusted to maintain the upstream pressure a defined magnitude higher than the downstream pressure. The pressure differential 330 will be provided as a function of the spring force.

As in previous embodiments, this pressure differential may be applied to the valve actuator 318 for appropriate operation of the valve 316.

Figure 7A:
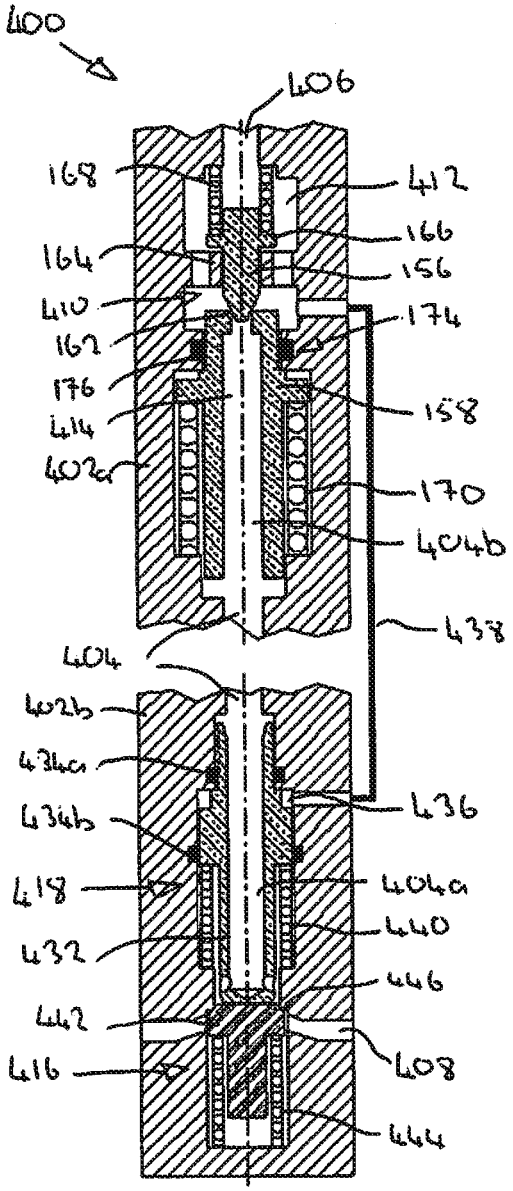
Figure 7B:
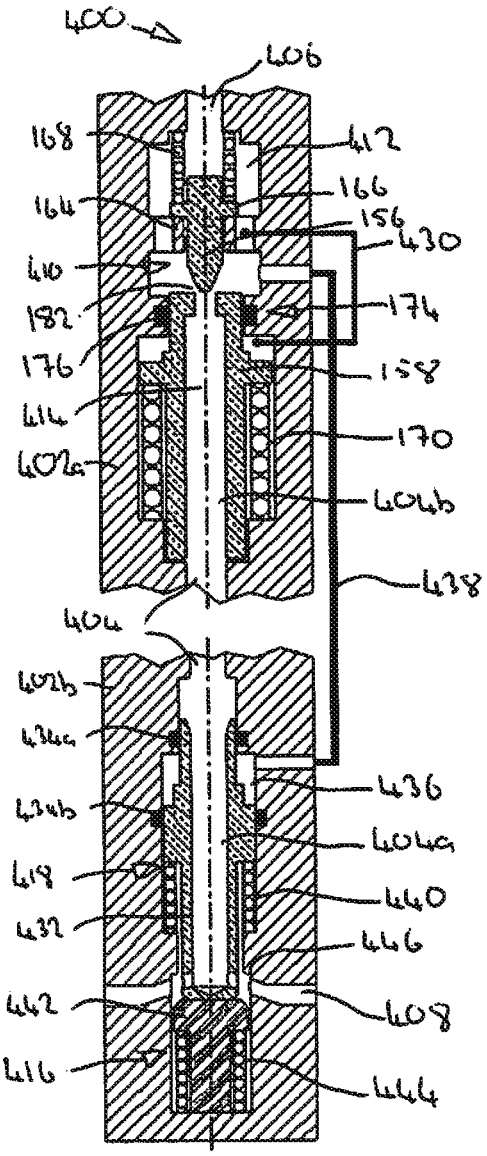

A further alternative embodiment of a flow system, specifically an injection apparatus, generally identified by reference numeral 400, is shown in FIGS. 7A and 7B, reference to which is now made. The apparatus 400 is shown in FIG. 7A in a closed configuration, and in FIG. 7B in an open or flowing configuration.

Apparatus 400 is similar to apparatus 300 of FIGS. 6A and 6B and as such like features share like reference numerals, incremented by 100. In view of the similarities between apparatus 300 and apparatus 400, only the differences will be highlighted. In this respect, the apparatus 400 is provided in modular form, and includes a first housing 402*a* which includes a pressure module 410, and a second housing 402*b* which includes a valve 416 and valve actuator 418. Each housing may be connected to each other via appropriate conduits or the like to provide a continuous flow path 404 through the entire system from an inlet 406 to an outlet. Further, pressure communication from an upstream side 412 of the pressure module 410 and the valve actuator may be achieved via an external conduit 438.

Figure 8A:
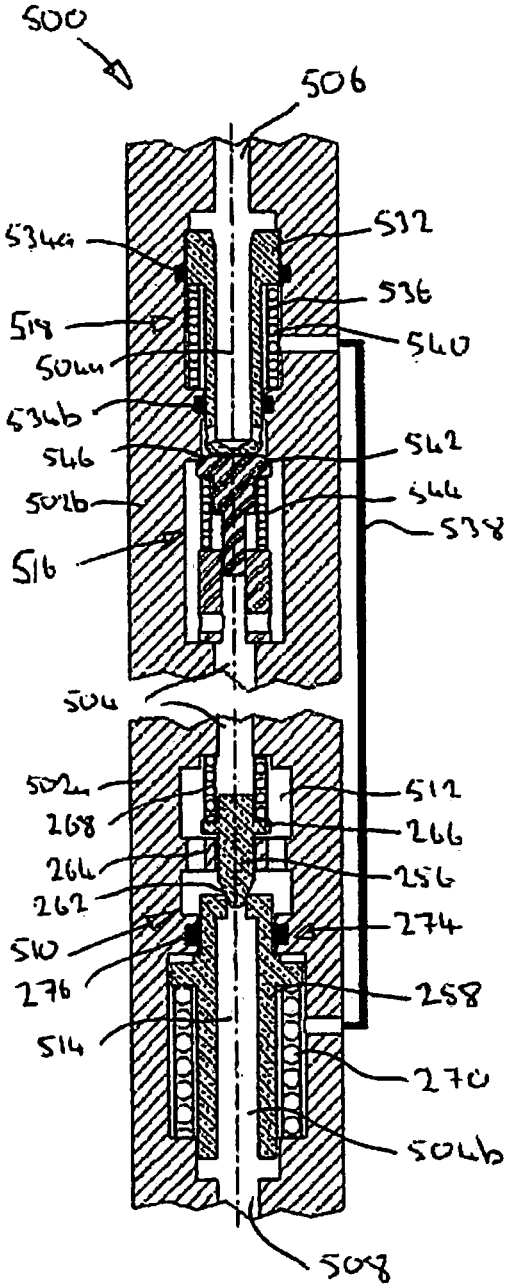
Figure 8B:
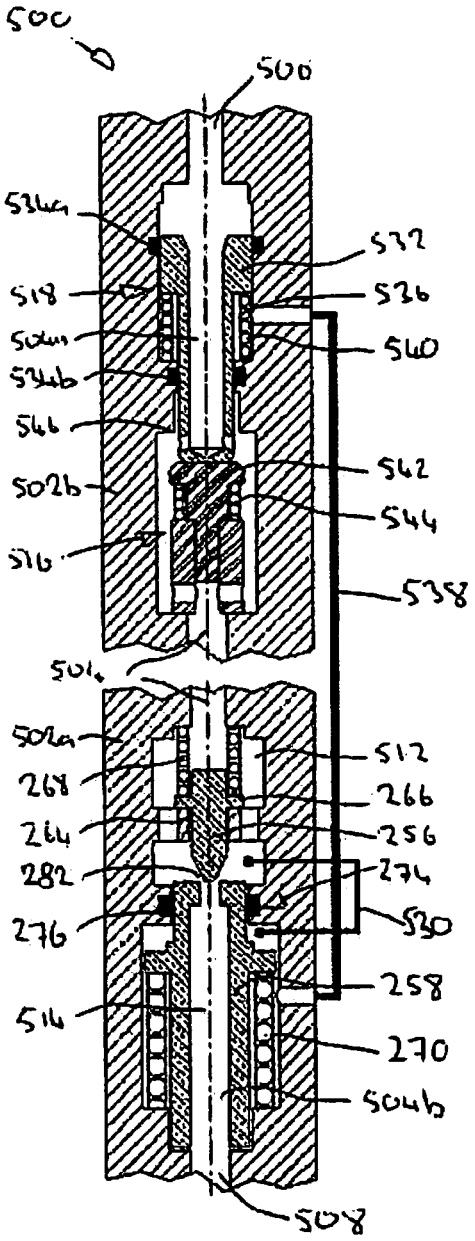

The apparatus 400 may operate in a similar manner to previously described apparatus (e.g., 100, 200, 300), and as such no further description will be given, In the apparatus 400 of FIGS. 7A and 7B the pressure module 410 is located upstream of the valve 416. However, this arrangement may be inverted, as illustrated in FIGS. 8A and 8B. In this case an apparatus 500 according to an alternative embodiment of the present invention includes a first housing 502*a* which includes a pressure module 510, and a second housing 502*b*, positioned upstream of the first housing 502*a*, and which includes a valve 516 and valve actuator. Apparatus 500 is otherwise similar to apparatus 400 of FIGS. 7A and 7B and as such similar reference numerals have been used for similar features, incremented by 100.

Figure 9A:
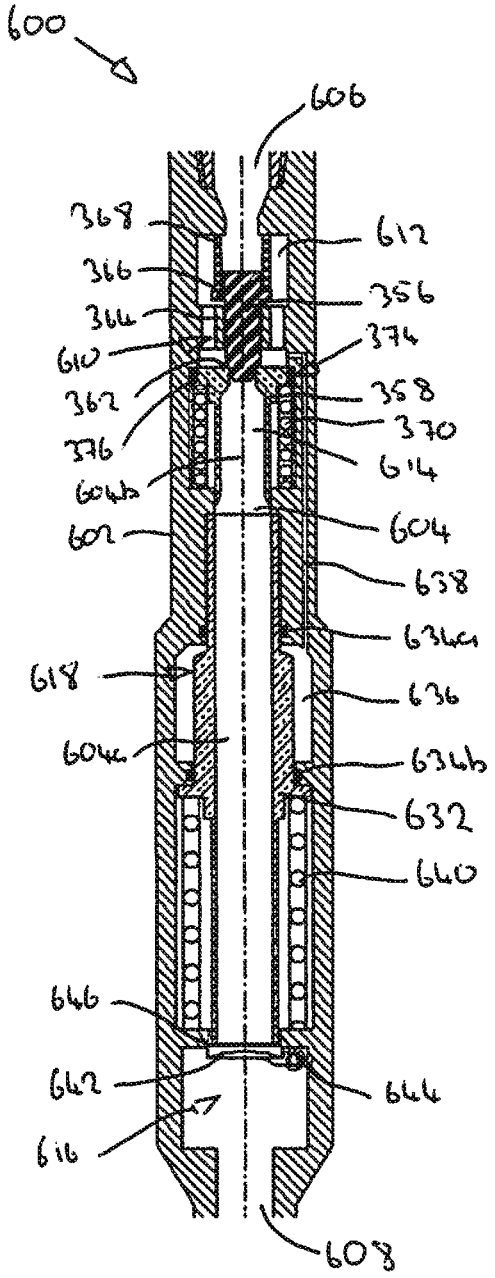
Figure 9B:
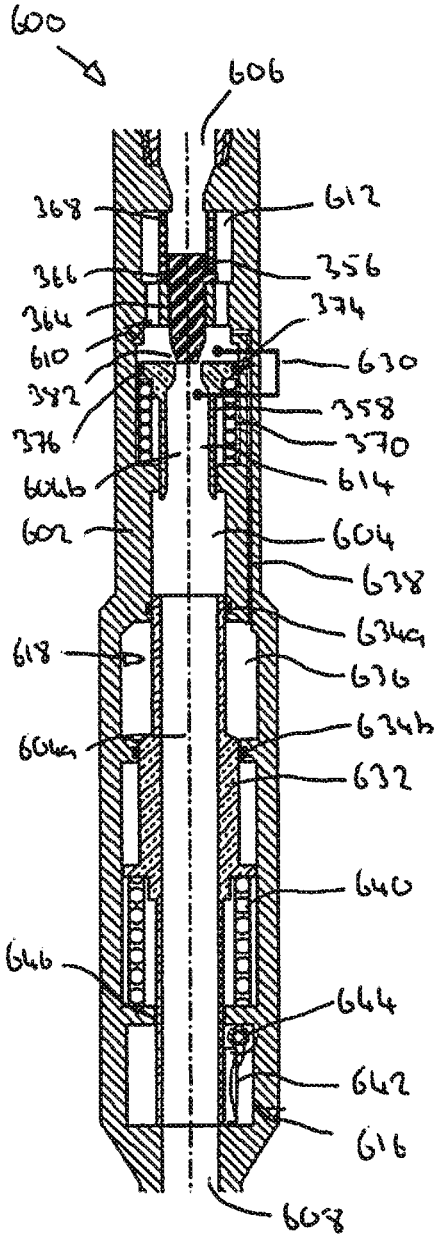

Reference is now made to FIGS. 9A and 9B in which there is shown a flow system, in particular an injection apparatus, generally identified by reference numeral 600, in accordance with an alternative embodiment of the present invention. The apparatus 600 is shown in a closed configuration in FIG. 9A, and in an open or flowing configuration in FIG. 9B. Apparatus 600 is similar to apparatus 300 of FIGS. 6A and 6B and as such like features share like reference numerals, incremented by 300. In this respect, apparatus 600 includes a housing 602 and a flow path 604 extending from an inlet 606 to an outlet 608.

A pressure module 610 is provided within the flow path 604 and functions to establish a pressure differential 630 (FIG. 9B) between upstream and downstream sides 612, 614 of the pressure module 610. The pressure module 610 includes first and second valve members 356, 358 which are both arranged for movement within the housing 602, wherein the first valve member 356 is provided in the form of a pin and defines a valve body member, and the second valve member 358 is provided, generally, in the form of a cylinder and defines a valve seat member. The second valve member 358 defines a flow path 604*b* therethrough which forms part of the flow path 604 through the housing 602. When the first and second valve members 356, 358 are engaged, as illustrated in FIG. 9A, the pressure module 610 is closed and a seal area 362 is defined. When the first and second valve members 356, 358 are separated a flow passage 382 (FIG. 9B) is defined, wherein the flow passage 382 provides a restriction to flow. This restriction therefore establishes a back pressure on the upstream side 614, thus functioning to maintain the upstream pressure above the downstream pressure.

The apparatus 600 further comprises a valve 616 within the flow path 604, wherein the valve comprises a flapper member 642 which is biased by a torsion spring 644 towards a closed position (FIG. 9A) in which the flapper member 642 seats against a valve seat 646.

The apparatus 600 also comprises a valve actuator 618 provided within the flow path 604. As will be described in more detail below, the valve actuator 618 is operated by the pressure differential established by the pressure module 610 to control the valve 616. More particularly, the valve actuator 618 is in pressure communication with the flow path 604 on upstream 612 and downstream 614 sides of the pressure module 610 to be driven by the differential pressure established by the pressure module 610 from a first position in which the valve 616 is closed, to a second position in which the valve 616 is opened.

The valve actuator 618 comprises an axially moveable actuating sleeve 632 mounted within the housing 602, in-line with the flow path 604. The actuating sleeve 632 defines a fluid bore 604*a* which forms part of the flow path 604 of the apparatus 600. As such, flow is permitted through the actuating sleeve 632.

The valve actuator 618 includes first and second sealing arrangements 634*a*, 634*b* axially arranged on the actuating sleeve 632 to establish sealing with the housing 602. In the illustrated example embodiment sealing arrangement 634*b* defines a larger sealing area than sealing arrangement 634*a*.

The sealing arrangements 634*a*, 634*b* define an actuator chamber 636 therebetween, wherein the chamber 636 is isolated from the flow path 604 on the downstream side 614 of the pressure module 610. The chamber 636 is presented in pressure communication with the upstream side 612 of the pressure module 610 via a bore conduit 638.

During use, pressure from the upstream side 612 of the pressure module 610 will act within the actuator chamber 636 over the sealing arrangements 634*a*, 634*b*. Due to the differential area of the sealing arrangements 634*a*, 634*b* the upstream pressure within the chamber 636 will act to urge the actuator sleeve 632 in a downstream direction (which is in a direction to open the valve 616). Further, as the valve actuator is positioned within the flow path 604 on the downstream side 614 of the pressure module 610, fluid pressure on this downstream side 614 will also act on the sealing arrangements 634*a*, 634*b*, and in view of the differential sealing area the downstream pressure will act to urge the actuator sleeve 632 in an upstream direction (which is in a direction to close the valve 616). Accordingly, movement of the actuator sleeve 632 will depend on the presence of a pressure differential between upstream and downstream sides 612, 614 of the pressure module 610.

The valve actuator 618 further includes an actuator biasing spring 640 which acts on the actuator sleeve 632 in an upstream direction, which permits the valve 616 to close. Accordingly, to achieve movement of the actuator sleeve 632 in the downstream direction the upstream pressure acting in the chamber 636 must exceed the combined effect of the downstream pressure and the action of the spring 640. As the upstream and downstream pressures effectively act over the same differential seal area, the spring 640 therefore functions to dictate the minimum required pressure differential to operate the valve actuator 618.

In use, to initiate flow the pressure at the inlet 606 will require to be elevated, for example by use of a pump (or the pressure at the outlet 608 reduced), until the pressure module 610 opens. Once the pressure module 610 is operating a pressure differential will be established, such that the pressure on the upstream side 612 will exceed the pressure on the downstream side 614. This pressure differential may be applied on the actuator sleeve 632 of the valve actuator 618, as described above, to cause said sleeve 632 to be urged in a downstream direction. The actuator sleeve 632 may then directly abut and push against the flapper member 642 and causing this to pivot and become lifted from its seat 646. In this embodiment the actuator sleeve 632 extends through the valve seat 646 until engaging a hard stop 90 on the housing 602, as shown in FIG. 9B. Thus, the sleeve 632 may effectively isolate the flapper member 642 and the valve seat 646 from flow, thus providing protection to the components of the valve 616.

Figure 10B:
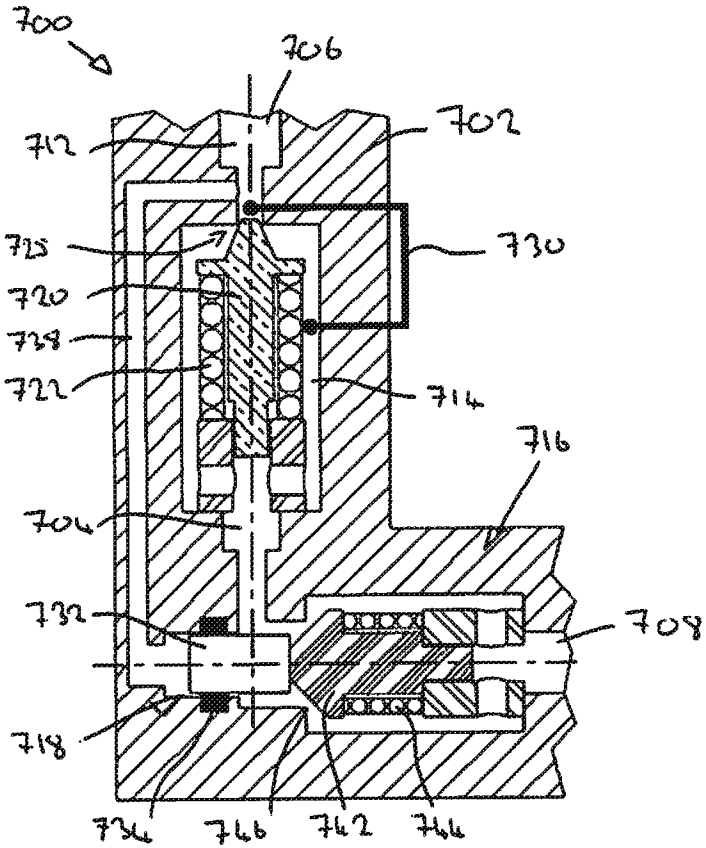
Figure 10A:
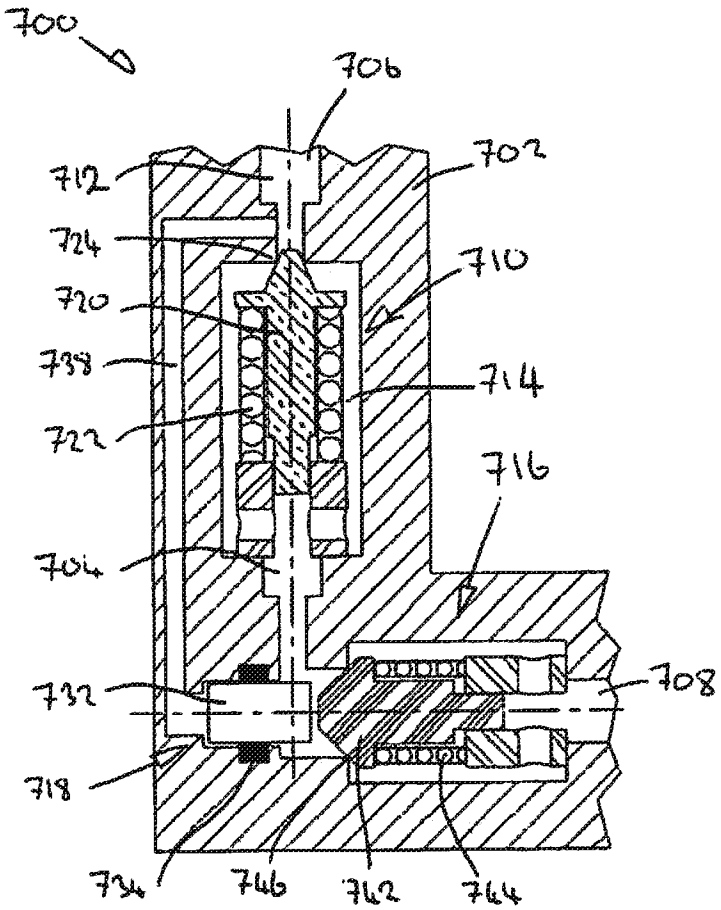

In the embodiments described above the valve actuator includes a pin or a sleeve which is directly mounted within and forms part of a flow path through the apparatus. However, in other embodiments this need not be the case. Such an embodiment is shown in FIGS. 10A and 10B, reference to which is now made. In this case a flow system, specifically an injection apparatus 700 is illustrated in FIG. 10A in a closed configuration, and in FIG. 10B in an open of flowing configuration. The apparatus 700 is similar to apparatus 100 shown in FIGS. 2A and 2B and as such like features share like reference numerals, incremented by 600.

The apparatus 700 includes a common housing 702 (either as a complete integrated housing or by separate housings or modules directly coupled together) and defines a system flow path 704 which extends between a system inlet 706 and a system outlet 708.

The apparatus 700 comprises a pressure module 710 which functions to establish a pressure differential in the flow path 704 between an upstream side 712 and a downstream side 714 of the pressure module 710.

The pressure module 710 comprises a pin 720 which is biased by a spring 722 towards a closed position in which the pin 720 sealingly engages a seat 724 to prevent flow through the flow path 704. To permit injection the fluid pressure at the inlet 706 must establish a downward force on the pin 720 which exceeds the combined force of the spring 722 and the pressure at the outlet 708, which act on the pin 720 in the opposing direction. When the inlet pressure is sufficient the pin 720 will be lifted from the seat 724, as shown in FIG. 10B, and in this configuration the pin 720 and seat 724 will define a flow restriction 725 within the flow path 704. This flow restriction 725 will therefore establish a back-pressure on the upstream side 712 of the pressure module 710. When in equilibrium, the force established by pressure on the upstream side 712 of the pressure module 710 will balance the combined force established by the spring 722 and the pressure on the downstream side 714 of the pressure module 710 (which can be considered to be the same pressure at the outlet 708). Accordingly, the effect of the pressure module 710 is to maintain the pressure at the inlet 706 at a fixed pressure differential (represented by line 730 in FIG. 10B) above the pressure at the outlet 708. This pressure differential will be dictated primarily by the force of the spring 722.

If the pressure at either the inlet 706 or the outlet 708 should vary, the pin 720 will move accordingly to adjust the flow restriction 725 and continuously seek force equilibrium, thus maintaining the pressure at the inlet 706 a fixed differential above the pressure at the outlet 708.

The apparatus 700 also comprises a valve 716 provided within the flow path 704. In the embodiment shown the valve 716 is a non-return or check valve and includes a poppet 742 which is mounted on a spring 744. The spring 744 acts to push the poppet 742 onto a seat 746, and thus biases the poppet 742 towards a closed position.

The apparatus 700 also comprises a valve actuator 718 which includes an axially moveable actuating pin 732 mounted within the housing 702. In this embodiment the pin 732 does not define any portion of the flow path 704. The valve actuator 718 includes a sealing arrangement 734 to establish sealing with the housing 702. One side of the sealing arrangement 734 is exposed to the flow path on the downstream side 714 of the pressure module 710 and thus exposed to downstream pressure. An opposite side of the sealing arrangement 734 is exposed to pressure on the upstream side 712 of the pressure module 710 via a pressure conduit 738. Accordingly, the presence of the differential pressure 730 (FIG. 10B) will cause the pin 732 to stroke and push the poppet 742 to be lifted from the seat 746. It should be noted that in this embodiment the valve actuator 718 does not include a spring, as in previous embodiments. Instead, any required spring bias may be provided by the spring 744 of the valve 716.

Figure 11B:
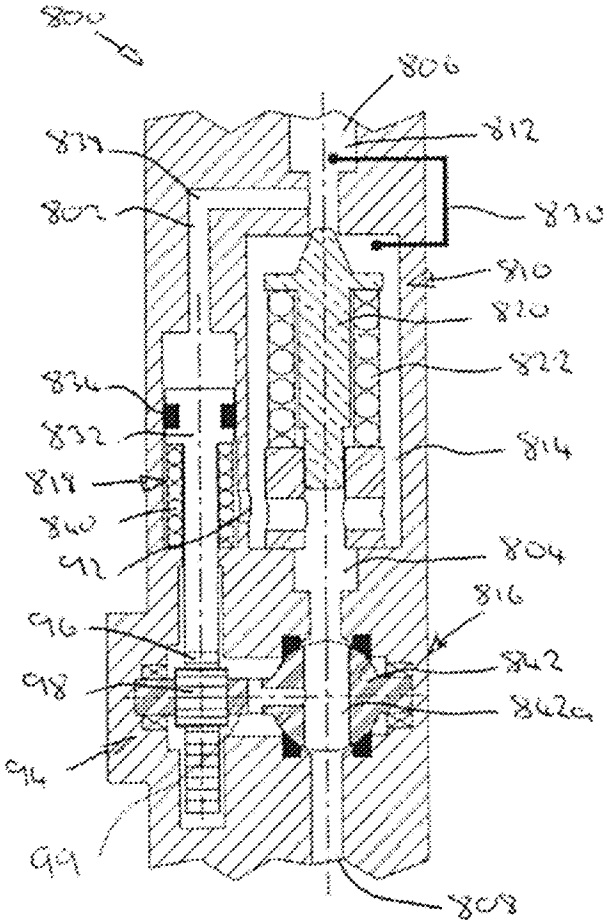
Figure 11A:
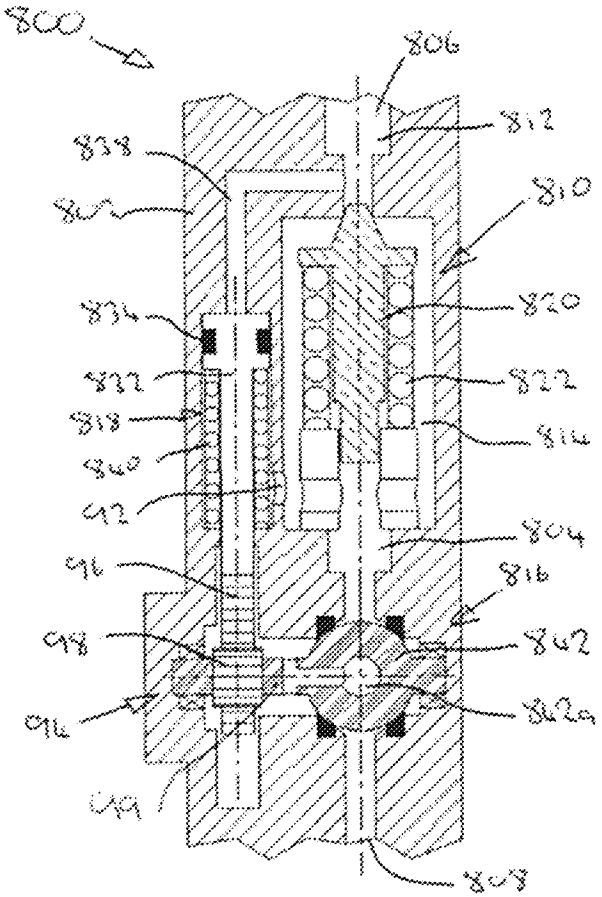

In many of the embodiments described above the valve includes a valve member (such as a ball or poppet) which is moved in a linear direction by a valve actuator. However, in other embodiments other valve motion may be accommodated. For example, rotational valve motion may be accommodated, such as in the flow system of FIGS. 11A and 11B, reference to which is now made. In this case FIG. 11A shows the flow system, specifically injection apparatus 800 in a closed configuration, and FIG. 11B shows the apparatus 800 in an open or flowing configuration.

Apparatus 800 is similar to apparatus 100 of FIGS. 2A and 2B, and as such like features share like reference numerals, incremented by 700. In this respect the apparatus 800 includes a housing 802 and defines a system flow path 804 which extends between a system inlet 806 and a system outlet 808.

The apparatus 800 comprises a pressure module 810 which functions to establish a pressure differential in the flow path 804 between an upstream side 812 and a downstream side 814 of the pressure module 810.

The pressure module 810 comprises a pin 820 which is biased by a spring 822 towards a closed position in which the pin 820 sealingly engages a seat 824 to prevent flow through the flow path 804. During flowing conditions the pin 820 is lifted from the seat 824, as shown in FIG. 10B, to define a flow restriction 825 therebetween. This flow restriction 825 will therefore establish a back-pressure on the upstream side 812 of the pressure module 810.

The apparatus 800 also comprises a valve 816 provided within the flow path 804. In the embodiment shown the valve 816 functions as a non-return or check valve and includes a rotatable ball 842 which includes a through bore 842*a*. When in a closed position (FIG. 11A) the valve bore 842*a* is not aligned with the flow path 804, and when in an open position (FIG. 11B) the valve bore 842*a* is aligned with the flow path 804.

The apparatus 800 also comprises a valve actuator 818 which includes an axially moveable actuating piston 832 mounted within the housing 702. In this embodiment the piston 832 does not define any portion of the flow path 804. The valve actuator 818 includes a sealing arrangement 834 to establish sealing with the housing 802. One side of the sealing arrangement 834 is exposed to the flow path on the downstream side 814 of the pressure module 810 via a communication port 92 and thus exposed to downstream pressure. An opposite side of the sealing arrangement 834 is exposed to pressure on the upstream side 812 of the pressure module 810 via a pressure conduit 838. Accordingly, the presence of the differential pressure 830 (FIG. 10B) will cause the piston 832 to stroke.

The piston 832 is connected to the ball valve member 842 via an interface assembly 94. This interface assembly includes a rack 96 which is coupled to the piston 832 and which rotatably drives a pinion wheel 98 which is rigidly secured to the ball 842 via shaft 99. Accordingly, stroking of the piston 832 in response to a pressure differential established by the pressure module 810 may cause rotation of the ball 842 between open and closed positions.

The valve actuator 818 also includes a spring 840 which functions to bias the piston 832 in a direction to close the valve 816.

Although not illustrated in FIGS. 11A and 11B, the ball 842*a* may define a port which permits pressure at the outlet 808 to be communicated with the valve actuator 818 when the ball 842 is closed. This arrangement might eliminate the requirement for the communication port 92. Further, this arrangement may minimise any hydraulic lock within the valve actuator 818.

It should be understood that the embodiments described herein are merely exemplary and that various modifications may be made thereto without departing from the scope of the invention. For example, one or more features defined in relation to any one embodiment may be applied or utilised within or in combination with any other embodiment. Further, in some embodiments the valve under control of a valve actuator may include a SSSV, for example.

The invention claimed is:

1. A flow system, comprising:

a system flow path extending from a system inlet to a system outlet;

a pressure module provided within the system flow path to establish a differential pressure between upstream and downstream sides thereof during flow from the system inlet to the system outlet;

a valve provided within the system flow path; and a valve actuator in pressure communication with the system flow path on upstream and downstream sides of the pressure module to be driven by a differential pressure established by the pressure module from a first position in which the valve is closed, to a second position in which the valve is opened, the pressure module being axially separate from the valve actuator along a longitudinal axis of the system flow path;

wherein a portion of the system flow path is within a bore of the valve actuator.

2. The flow system according to claim 1, wherein the valve is a closed valve.

3. The flow system according to claim 1, wherein the valve actuator is operated by the differential pressure to fully open the valve when said actuator is in its second position.

4. The flow system according to claim 1, wherein the valve actuator is movable towards the second position when the pressure differential exceeds a threshold value.

5. The flow system according to claim 1, comprising a valve actuator biasing arrangement for biasing the valve actuator in one direction.

6. The flow system according to claim 5, wherein the actuator biasing arrangement biases the valve actuator towards the first position.

7. The flow system according to claim 1, wherein the valve actuator comprises or defines an actuator piston operable by the pressure differential established by the pressure module.

8. The flow system according to claim 1, configured such that pressure upstream of the pressure module is communicated to act on the valve actuator in one direction, and pressure downstream of the pressure module is communicated to act on the valve actuator in an opposite direction.

9. The flow system according to claim 1, configured such that pressure upstream of the pressure module is communicated to act on the valve actuator to urge said actuator from its first position towards its second position, and pressure downstream of the pressure module is communicated to act on the valve actuator to urge said actuator from its second position to its first position.

10. The flow system according to claim 1, comprising an actuator housing, wherein the valve actuator is mounted and moveable within said actuator housing.

11. The flow system according to claim 10, comprising an actuator sealing arrangement providing sealing between the valve actuator and the actuator housing.

12. The flow system according to claim 11, wherein the actuator sealing arrangement define a dynamic sealing arrangement to permit sealing to be achieved during relative movement of the valve actuator and actuator housing.

13. The flow system according to claim 11, where one side of the actuator sealing arrangement is in pressure communication with the system flow path on the upstream side of the pressure module, and an opposite side of the actuator sealing arrangement is in pressure communication with the system flow path on the downstream side of the pressure module.

14. The flow system according to claim 10, comprising at least two actuator sealing arrangements providing at least two regions of sealing between the valve actuator and the actuator housing.

15. The flow system according to claim 14, wherein at least two actuator sealing arrangements define an actuator chamber therebetween.

16. The flow system according to claim 15, wherein the actuator chamber is arranged in pressure communication with the system flow path on one of the upstream and downstream sides of the pressure module.

17. The flow system according to claim 14, wherein at least two actuator sealing arrangements define different sealing areas to establish a differential piston area.

18. The flow system according to claim 1, wherein the valve actuator is mounted within the system flow path.

19. The flow system according to claim 1, wherein the valve actuator defines a portion of the system flow path.

20. The flow system according to claim 1, wherein the valve is downstream of the valve actuator.

21. The flow system according to claim 1, comprising an actuator chamber on an outer surface of the valve actuator, wherein said actuator chamber is isolated from a flow path of the valve actuator.

22. The flow system according to claim 21, wherein the actuator chamber is defined between two sealing arrangements positioned between the valve actuator and a surrounding housing.

23. The flow system according to claim 1, wherein the valve actuator comprises at least one of a pin, a sleeve and a tube.

24. The flow system according to claim 1, wherein the valve actuator is in pressure communication with the flow path on one or both sides of the pressure module by direct fluid communication.

25. The flow system according to claim 1, comprising one or more pressure conduits to permit pressure communication of the flow path with the valve actuator.

26. The flow system according to claim 1, wherein, in use, flow from the system inlet to the system outlet is in a forward direction, and flow from the system outlet to the system inlet is in a reverse direction, and wherein the valve is operable to be positively closed by any reverse flow.

27. The flow system according to claim 1, wherein the valve is operable to be opened by the valve actuator, and closed by action of fluid downstream of the system.

28. The flow system according to claim 1, wherein the valve comprises a valve biasing arrangement.

29. The flow system according to claim 28, wherein the valve biasing arrangement is configured to bias the valve towards a closed position.

30. The flow system according to claim 28, wherein the valve biasing arrangement functions to bias the valve actuator.

31. The flow system according to claim 1, comprising an actuator biasing arrangement for biasing the valve actuator in a desired direction.

32. The flow system according to claim 1, wherein the valve comprises a valve member to be moved by the valve actuator between open and closed positions.

33. The flow system according to claim 32, wherein the valve comprises a valve seal arrangement to cooperate with the valve member to permit sealing when the valve is closed.

34. The flow system according to claim 33, wherein the valve seal arrangement is provided on a valve seat.

35. The flow system according to claim 34, wherein the valve actuator extends through a valve seat portion of the valve when said valve actuator is moved towards its second position.

36. The flow system according to claim 32, wherein the valve actuator is provided separately from the valve member and arranged, engaged or coupled relative to the valve member.

37. The flow system according to claim 32, wherein the valve member defines a linear valve member.

38. The flow system according to claim 32, wherein the valve member comprises a rotary valve member.

39. The flow system according to claim 32, wherein the valve member comprises a pivoting valve member.

40. The flow system according to claim 1, comprising a valve interface arrangement configured to permit the valve actuator to operate the valve.

41. The flow system according to claim 40, wherein the valve interface arrangement is operable to convert one motion of the valve actuator to a different motion of the valve.

42. The flow system according to claim 1, wherein the valve and the pressure module are separate.

43. The flow system according to claim 1, wherein the valve and the pressure module are provided in a common module.

44. The flow system according to claim 1, wherein the pressure module is operable to provide a differential pressure which is sufficient to operate the valve actuator.

45. The flow system according to claim 1, wherein the pressure module is configured to provide a minimum pressure differential during any flow necessary to operate the valve actuator, such that any operational state of the pressure module will cause the valve actuator to be urged towards its second position and operate the valve.

46. The flow system according to claim 1, wherein the pressure module is operable to maintain the pressure of the upstream side of the pressure module at a defined value below or above the downstream side.

47. The flow system according to claim 1, wherein the pressure module comprises a flow restriction within the system flow path.

48. The flow system according to claim 1, wherein the flow system provides a downhole injection system.

49. A method for flow control, comprising:

delivering a fluid to an inlet of a flow path;

permitting the fluid to flow through a pressure module to create a pressure differential within the fluid on upstream and downstream sides of the pressure module; and controlling a valve actuator with the pressure differential such that in response to the pressure differential the valve actuator is urged from a first position in which a valve within the flow path is closed, to a second position in which the valve is opened, the pressure module being axially separate from the valve actuator along a longitudinal axis;

wherein a portion of the flow path is within a bore of the valve actuator.

50. The method according to claim 49, comprising using a flow system including:

the flow path extending from the inlet to a system outlet;

the pressure module provided within the flow path to establish the pressure differential between the upstream and downstream sides thereof during flow from the inlet to the system outlet;

the valve provided within the flow path; and the valve actuator in pressure communication with the flow path on the upstream and downstream sides of the pressure module to be driven by the pressure differential established by the pressure module from the first position in which the valve is closed, to the second position in which the valve is opened.

* * * * *